US012383064B1

(12) United States Patent
Shin

(10) Patent No.: US 12,383,064 B1
(45) Date of Patent: Aug. 12, 2025

(54) FOLDING CHAIR CONSTRUCTION

(71) Applicant: Commercial Seating Products, Inc., South Hackensack, NJ (US)

(72) Inventor: Justin H. Shin, Upper Saddle River, NJ (US)

(73) Assignee: Commerical Seating Products, Inc., South Hackensack, NJ (US)

( * ) Notice: Subject to any disclaimer, the term of this patent is extended or adjusted under 35 U.S.C. 154(b) by 189 days.

(21) Appl. No.: 18/233,492

(22) Filed: Aug. 14, 2023

(51) Int. Cl.
*A47C 4/00* (2006.01)
*A47C 4/10* (2006.01)
*A47C 5/12* (2006.01)

(52) U.S. Cl.
CPC . *A47C 4/10* (2013.01); *A47C 5/12* (2013.01)

(58) Field of Classification Search
CPC .... A47C 3/04; A47C 4/24; A47C 4/14; A47C 4/10; A47C 4/28; A47C 4/04
See application file for complete search history.

(56) References Cited

U.S. PATENT DOCUMENTS 1,129,793 A * 2/1915 Craig ..... A47C 4/24 297/58
1,721,294 A * 7/1929 Edward ..... A47C 4/14 297/58
1,884,257 A * 10/1932 Ronk ..... A47C 4/24 297/58
2,350,895 A * 6/1944 Hoover, Jr. ..... A47C 4/14 297/58
2,406,305 A * 8/1946 Maurer ..... A47C 4/14 297/58
4,008,918 A * 2/1977 Cooper ..... A47D 1/008 297/148
4,958,885 A * 9/1990 Kassai ..... A47D 1/023 297/55
5,037,116 A * 8/1991 Desanta ..... A47C 3/045 297/39
5,044,690 A * 9/1991 Torrey ..... A47C 4/283 297/440.11
5,096,259 A * 3/1992 Stanfield ..... A47C 3/04 297/239
5,435,620 A * 7/1995 Cheng ..... A47C 4/20 297/51
5,624,153 A * 4/1997 Censullo, Jr. ..... A47C 4/08 297/16.2
5,738,408 A * 4/1998 Wu ..... A47C 3/04 297/440.22
5,967,605 A * 10/1999 Stanfield ..... A47C 3/04 297/239
6,092,866 A * 7/2000 Wu ..... A47C 4/24 297/16.1
6,099,073 A * 8/2000 Bruschi ..... A47C 4/14 297/440.22

(Continued)

*Primary Examiner* — Shin H Kim
(74) *Attorney, Agent, or Firm* — Richard M. Goldberg

(57) ABSTRACT

A folding chair for movement between a folded condition and an unfolded erect condition, includes a frame member and support member pivotally connected to each other, a seat member pivotally mounted to the frame member, and two arrangements for preventing longitudinal sliding movement of two of the chairs stacked upon one another and two arrangements for preventing transverse longitudinal sliding movement of two of the chairs stacked upon one another.

11 Claims, 20 Drawing Sheets

(56) References Cited

U.S. PATENT DOCUMENTS 6,234,571 B1 * 5/2001 Atkins ..... A47C 3/04 297/239
6,279,991 B1 * 8/2001 Atkins ..... A47C 4/24 297/55
6,305,742 B1 * 10/2001 Spendlove ..... A47C 4/24 297/55
6,386,627 B1 * 5/2002 Tsai ..... A47C 4/24 297/58
D467,089 S * 12/2002 Wu ..... D6/368
6,517,151 B2 * 2/2003 Liu ..... A47C 4/10 297/16.2
6,592,182 B1 * 7/2003 Noor ..... A47C 4/10 297/440.22
6,669,281 B1 * 12/2003 Huang ..... A47C 7/002 297/440.22
6,890,026 B1 5/2005 Shin
6,953,221 B1 * 10/2005 Tseng ..... A47C 4/10 297/23
6,969,113 B2 * 11/2005 Krawchuk ..... A47C 3/04 297/DIG. 2
D537,641 S * 3/2007 Byers, II ..... D6/335
7,328,942 B1 * 2/2008 Wu ..... A47C 4/24 297/183.5
7,350,324 B2 * 4/2008 Wu ..... G09F 23/00 297/219.1
7,758,112 B2 * 7/2010 Huang ..... A47C 4/025 297/23
8,029,059 B2 * 10/2011 Smith ..... A47C 4/38 248/188.8
D648,554 S * 11/2011 Smith ..... D6/368
D660,612 S * 5/2012 Smith ..... D6/374
8,317,269 B2 * 11/2012 Smith ..... A47C 7/54 297/440.11
8,322,787 B2 * 12/2012 Smith ..... A47C 3/04 403/396
8,454,093 B2 * 6/2013 Smith ..... A47C 4/48 297/452.21
11,071,388 B2 * 7/2021 Leng ..... A47C 3/40
D935,212 S * 11/2021 Chuah ..... D6/368
D984,159 S * 4/2023 Angel ..... D6/370
12,239,236 B2 * 3/2025 Preutz ..... A47C 4/04

* cited by examiner

FOLDING CHAIR CONSTRUCTION

BACKGROUND OF THE INVENTION

The present invention relates generally to folding chairs, and more specifically, to folding chairs constructed of synthetic polymeric materials and having structural features enabling lighter weight, greater strength, increased comfort and safety, with the ability to be stacked, when folded, in uniform, stable stacks with a wide arrangement of different folding chairs.

Folding chairs have found widespread use in supplying temporary seating for varying numbers of attendees at functions held at many different sites. When not in use, these chairs are folded and then stacked for storage and transportation. The more desirable of these folding chairs have essentially the same appearance so that when multiple like chairs are set-up at a particular function, these multiple chairs present an aesthetically pleasing uniform arrangement of seats.

For many years, the folding chair of choice has been constructed mainly of wood, with a uniform finish. These wooden folding chairs provide a combination of comfortable seating and aesthetic appearance found to be most desirable among audiences attending a wide variety of functions. However, such wooden chairs lack long-term durability and require frequent attention in order to maintain both comfort and appearance, as well as safety through structural integrity. Moreover, these wooden chairs are more difficult to stack in effective, stable stacks.

More recently, folding chairs have been constructed of synthetic polymeric materials in an effort to overcome the shortcomings of wooden folding chairs. Generally, these plastic chairs have proven to be more durable than wooden chairs. In addition, the added flexibility in construction has enabled the incorporation of structural features which allow convenient and effective stacking. However, the cost of materials, as well as strength, weight and safety considerations, has hampered the ability to simulate, in chairs constructed of suitable synthetic polymeric materials, the desired aesthetic appearance, comfort and safety provided by the now-traditional wooden chairs.

U.S. Pat. No. 6,890,026, by the same inventor herein, and the entire disclosure of which is incorporated herein by reference, overcomes the above-outlined shortcomings of wooden folding chairs and previously available synthetic polymeric chairs, in a chair construction readily manufactured of synthetic polymeric materials.

As such, the invention of this patent provides the following objects and advantages:

a) provides a folding chair constructed for ready manufacture of a synthetic polymeric material, while simulating closely the aesthetic appearance and seating comfort of previous folding chairs constructed of wood;
b) provides folding chairs of synthetic polymeric materials constructed to conserve material and weight while attaining enhanced strength, comfort and safety, as well as a desired aesthetic appearance;
c) militates against injury to a seated person or damage to a seated person's clothing;
d) prevents damage to like chairs which otherwise could result from contact among such like chairs, either when arranged at the site of a function or when stacked for storage and transportation;

e) enables effective stacking, when folded, in stable, compact and uniform stacks for ready storage and transportation;
f) provides folding chairs of increased strength and durability, while more closely simulating the aesthetic appearance of traditional wooden folding chairs;
g) facilitates the operation of a folding chair for increased ease of erection and folding; and
h) enables the economical manufacture of folding chairs requiring less maintenance over an increased service life.

However, in the flattened or closed state of the chair, stacking is generally limited to the same type of chair. In other words, different constructions of certain similar types of chairs cannot be stacked with the chair of this patent.

It would therefore be desirable to provide a chair of the type of this patent that has more universal stacking ability in a closed or flattened state, with different constructions of certain similar types of chairs.

OBJECTS AND SUMMARY OF THE INVENTION

Accordingly, it is an object of the present invention to provide a folding chair that overcomes the aforementioned problems.

It is another object of the present invention to provide a folding chair that includes multiple arrangements to prevent relative longitudinal movement of the folding chairs in a stacked configuration.

It is still another object of the present invention to provide a folding chair that includes multiple arrangements to prevent relative transverse movement of the folding chairs in a stacked configuration.

In accordance with the present invention, a folding chair for movement between a folded condition and an unfolded erect condition, includes a frame member extending in a frame member lengthwise direction between a base and an opposite top. The frame member includes a pair of side rails extending in parallel, spaced apart relation in the lengthwise direction, each side rail extending longitudinally between a basal end at the base of the frame member and a top end at the top of the frame member, a back rest extending in a lateral direction between the side rails, adjacent the top ends of the side rails, the back rest connected at opposite ends thereof with the side rails, a basal brace extending in the lateral direction between the side rails adjacent the basal ends of the side rails, and a frame brace extending laterally between the side rails intermediate the basal end and the top end of each side rail.

The folding chair further includes a support member extending in a support member lengthwise direction thereof between a foot and an opposite head. The support member includes a pair of side supports extending in parallel, spaced apart relation in the support member lengthwise direction, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support.

A first pivotal mounting arrangement mounts the support member to the frame member for pivotal movement of the support member between a folded position and an erect unfolded position. The first pivotal mounting arrangement includes a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position.

A seat member includes a front section, a rear section and opposite seat side sections extending between and connected to the front and rear sections, the seat member having a seat surface and an opposite undersurface. A second pivotal mounting arrangement mounts the seat member to the frame member, with the seat member positioned between the side rails of the frame member, for movement between a retracted position and an extended position. The second pivotal mounting arrangement includes a second pivot placed intermediate the front section and the rear section of the seat member and pivotally mounts the seat member to the side rails at a second pivotal location juxtaposed with the frame brace such that the seat member is nested within the frame member, laterally between the side rails, when in the retracted position corresponding to the folded position, and the undersurface of the seat member rests upon the frame brace when in the extended position corresponding to the erect unfolded position.

A coupling arrangement couples the rear section of the seat member with the support member for securing the seat member in the extended position when the chair is in the erect unfolded position.

In accordance with a first aspect of the present invention, there are at least one first stacking rib extending along and projecting orthogonally from one of a rear surface of the foot brace, rear surfaces of the side supports, or both the rear surface of the foot brace and the rear surfaces of the side supports, at a position adjacent the foot of the support member; and second stacking ribs extending along and projecting orthogonally from the rear surfaces of the side supports in spaced apart relation from the at least one first stacking rib, to define a gap between the at least one first stacking rib and the second stacking ribs, for receiving the basal brace of another chair stacked thereon, to preclude relative movement between the stacked chairs in longitudinal directions thereof, whereby the stacked chairs establish a uniform stable stack of like chairs.

Preferably, the at least one first stacking rib includes a single stacking rib extending along and projecting orthogonally from both the rear surface of the foot brace and the rear surfaces of the side supports.

In accordance with a second aspect of the present invention, there is a coupling arrangement coupling the rear section of the seat member with the support member for securing the seat member in the extended position when the chair is in the erect unfolded position, the coupling arrangement including a guide wall extending upwardly from the rear section of the seat member. The guide wall includes an extension wall extending outwardly from the guide wall and past the plane of rear surfaces of the side supports when the chair is in its folded condition, for releasably engaging with the support brace in the unfolded erect condition of the chair to releasably retain the chair in the unfolded erect condition.

Also, a restraining bar extends downwardly from the rear section of the seat member for engaging with the extension wall of another chair when the chairs are provided one on top of another in a stacked relation, to preclude relative movement between the stacked chairs in longitudinal directions thereof, whereby the stacked chairs establish a uniform stable stack of like chairs.

The extension wall extends upwardly from a free end of the guide wall and is shorter than the guide wall, as measured in the transverse direction of the chair, the extension wall having a front surface spaced slightly inwardly from the front surface of the guide wall, so as to define a shoulder at the connection of the guide wall with the extension wall at the front surfaces thereof, such that the support brace of another stacked chair thereon engages the front surface of the extension wall, and is limited by the shoulder.

Preferably, the extension wall has a rear surface which is coplanar with a rear surface of the guide wall.

In addition, each side support of the support member includes a track confronting a corresponding side of the seat member. The seat member includes a follower projecting from each side of the seat member and engaged with a corresponding track for effecting simultaneous movement of the seat member between the retracted position and the extended position and of the support member between the folded position and the erect position, the terminal end of each track confronting and spaced away from a corresponding follower when the seat member is in the unfolded erect position so as to preclude engagement of the follower with the terminal end when the seat member is in the erect position.

Preferably, the followers project from ends of the guide wall.

In accordance with a third aspect of the present invention, there is an arrangement for preventing transverse relative movement between two the chairs stacked one upon another. The arrangement includes restraining fingers extending outwardly from an undersurface of the opposite seat side sections of the seat member, each restraining finger extending in the lengthwise direction of the seat side sections, the restraining fingers fitting within and positioned immediately adjacent and in juxtaposition to inner surfaces of the side supports of another the chair stacked thereover, to prevent transverse relative movement between the stacked chairs.

The arrangement further includes at least one first stacking rib extending along and projecting orthogonally from one of rear surfaces of the side supports, or both a rear surface of the foot brace and the rear surfaces of the side supports, at a position adjacent the foot of the support member, the at least one first stacking rib having opposite rib ends. In conjunction therewith, there are inwardly facing raised bosses at inner surfaces of the side supports such that, in a stacking arrangement of two the chairs, the at least one first stacking rib of one the stacked chair fits between the inwardly facing raised bosses of another the stacked chair, with the opposite rib ends of the stacking rib in close proximity to the raised bosses of the other chair, to prevent transverse movement of the stacked chairs relative to each other.

Preferably, the inwardly facing raised bosses are provided at the inner surface of each side support at a position immediately above the basal brace. The above and other objects, features and advantages of the invention will become readily apparent from the following detailed description thereof which is to be read in connection with the accompanying drawings.

In accordance with a fourth aspect of the present invention, the support member further includes a projection on a front facing surface of at least one said side support at a position slightly below the support brace which causes the rear section of the seat member to forcibly ride thereover when moving the chair from the folded condition to the unfolded erect condition, to retain the chair in the folded configuration. Preferably, there is one projection on the front facing surface of both side supports.

The above and other objects, features and advantages of the invention will become readily apparent from the following detailed description thereof which is to be read in connection with the accompanying drawings.

DETAILED DESCRIPTION

Figure 1:
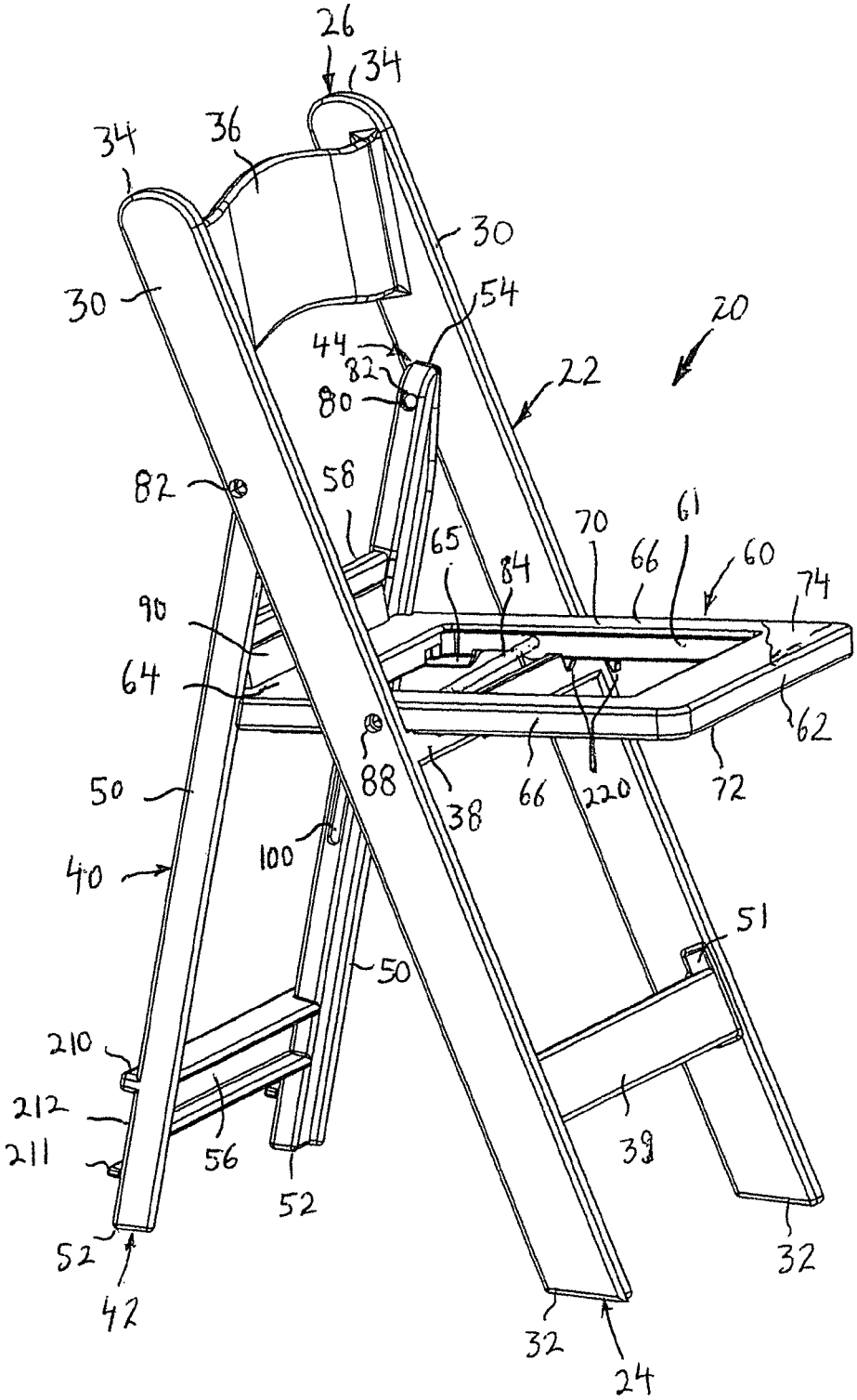
FIG. 1 is a front perspective view of a folding chair constructed in accordance with the present invention, with the chair in an erected, unfolded operative position.
Figure 2:
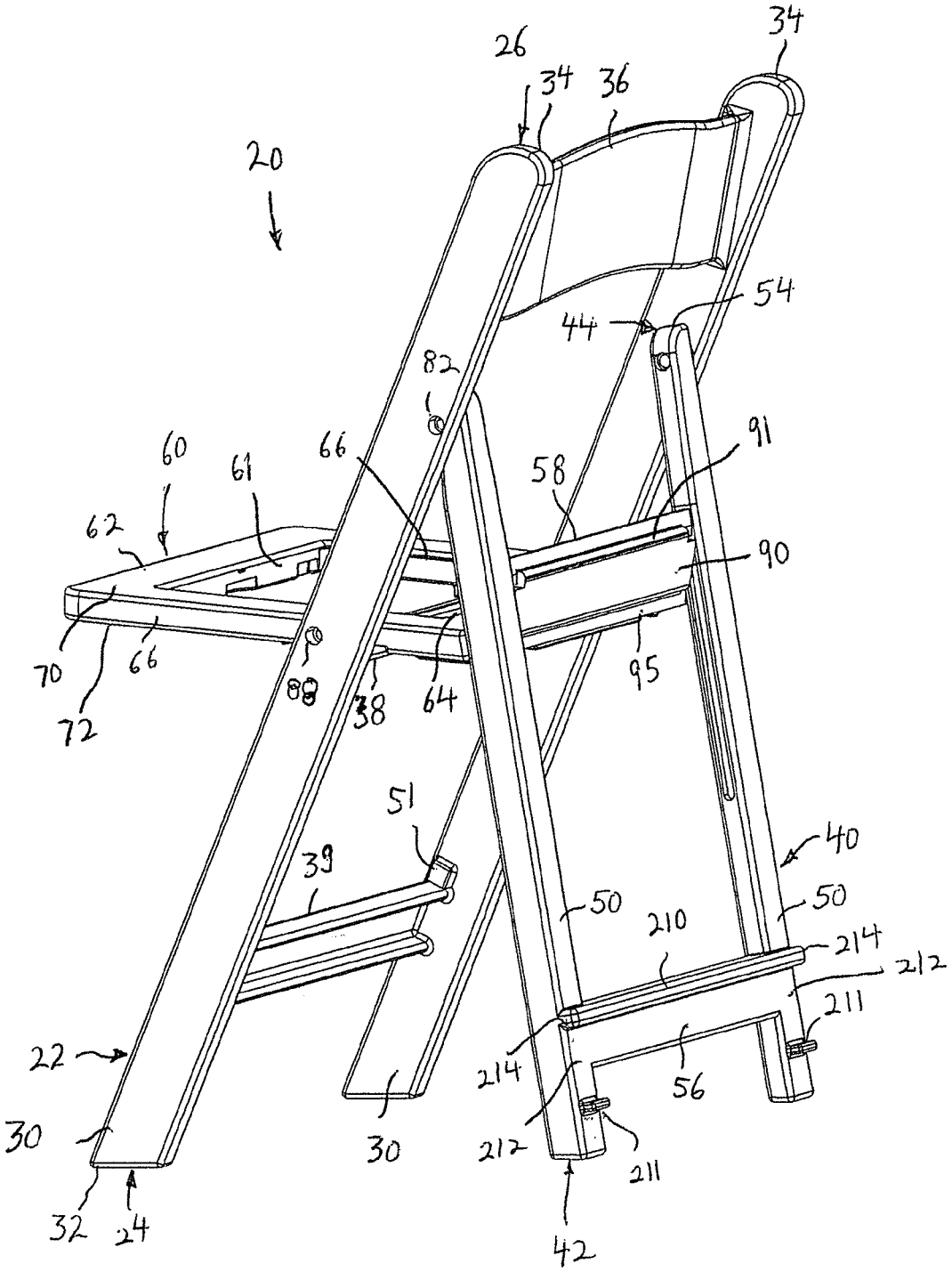
FIG. 2 is a rear perspective view of the folding chair of FIG. 1.
Figure 3:
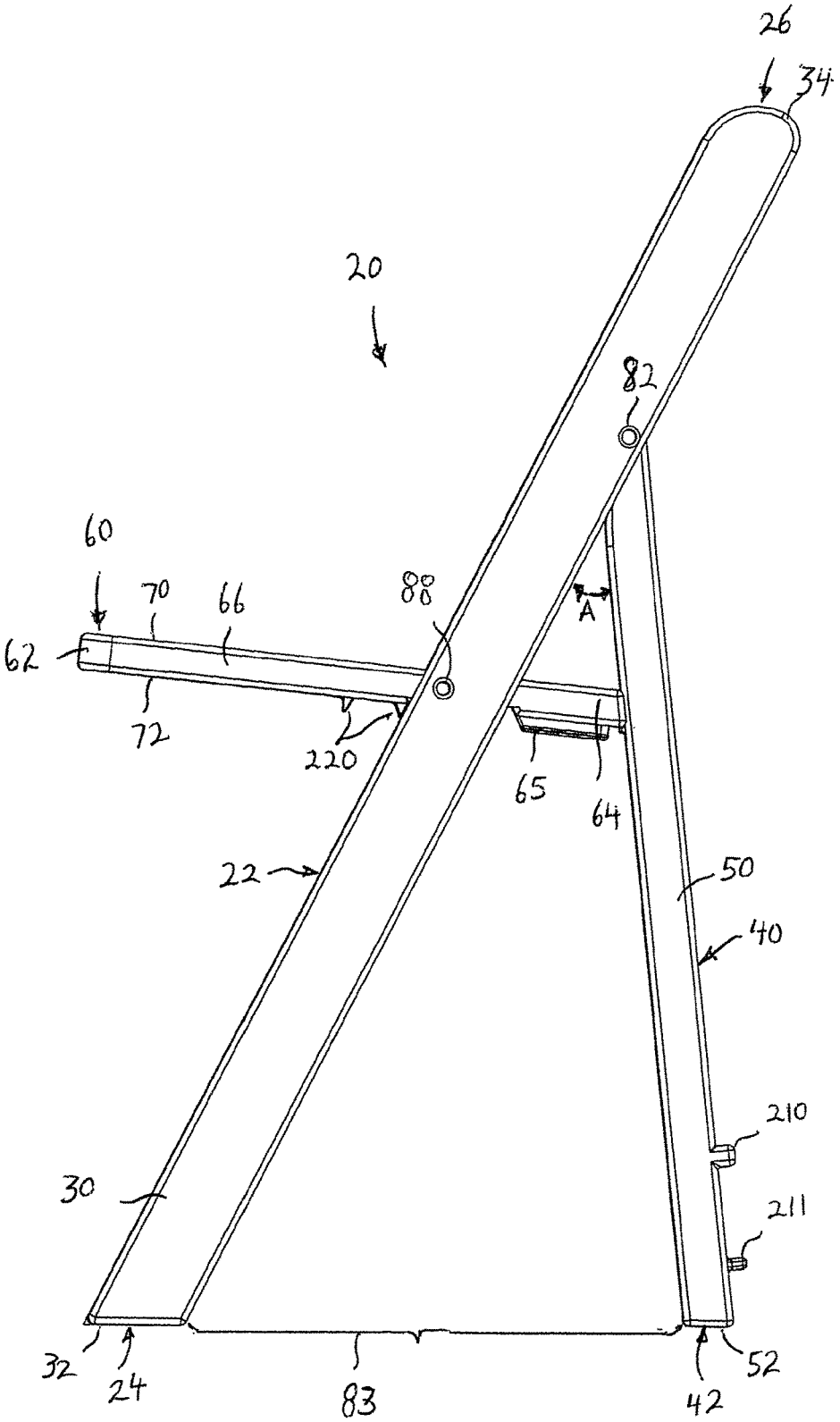
FIG. 3 is a side elevational view of the erected chair of FIG. 1.
Figure 4:
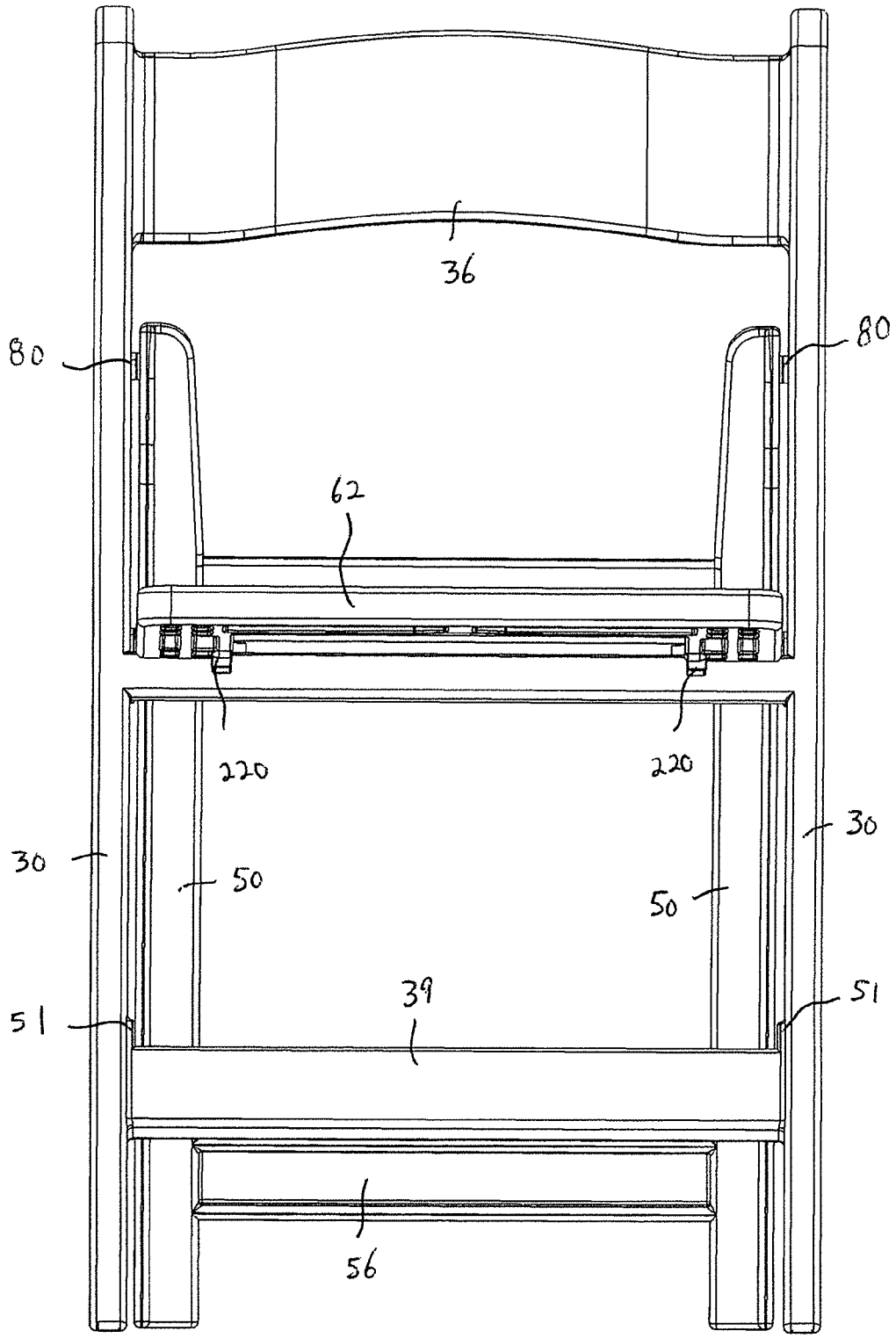
FIG. 4 is a front elevational view of the folding chair of FIG. 1.
Figure 5:
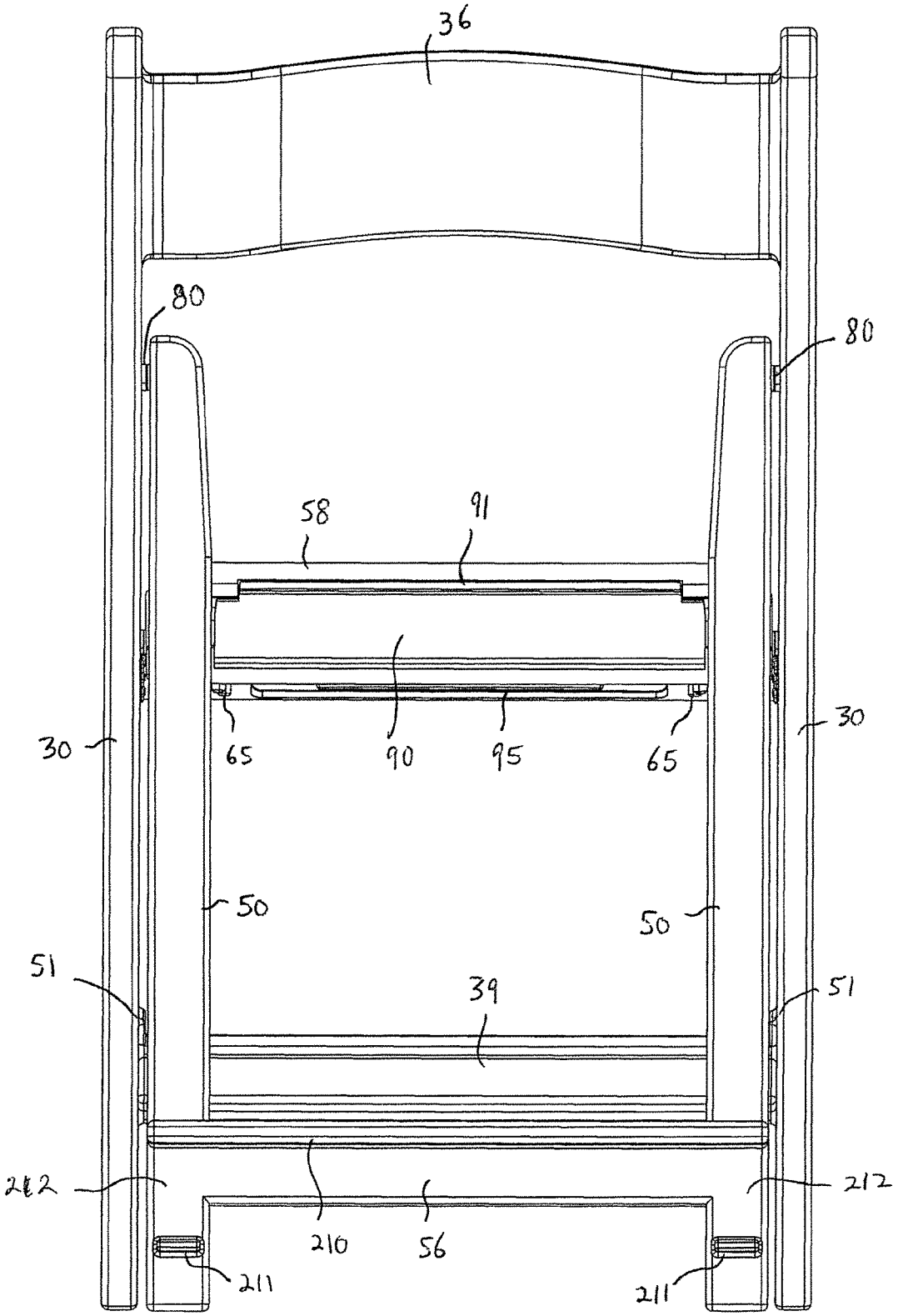
FIG. 5 is a rear elevational view of the folding chair of FIG. 1.
Figure 6:
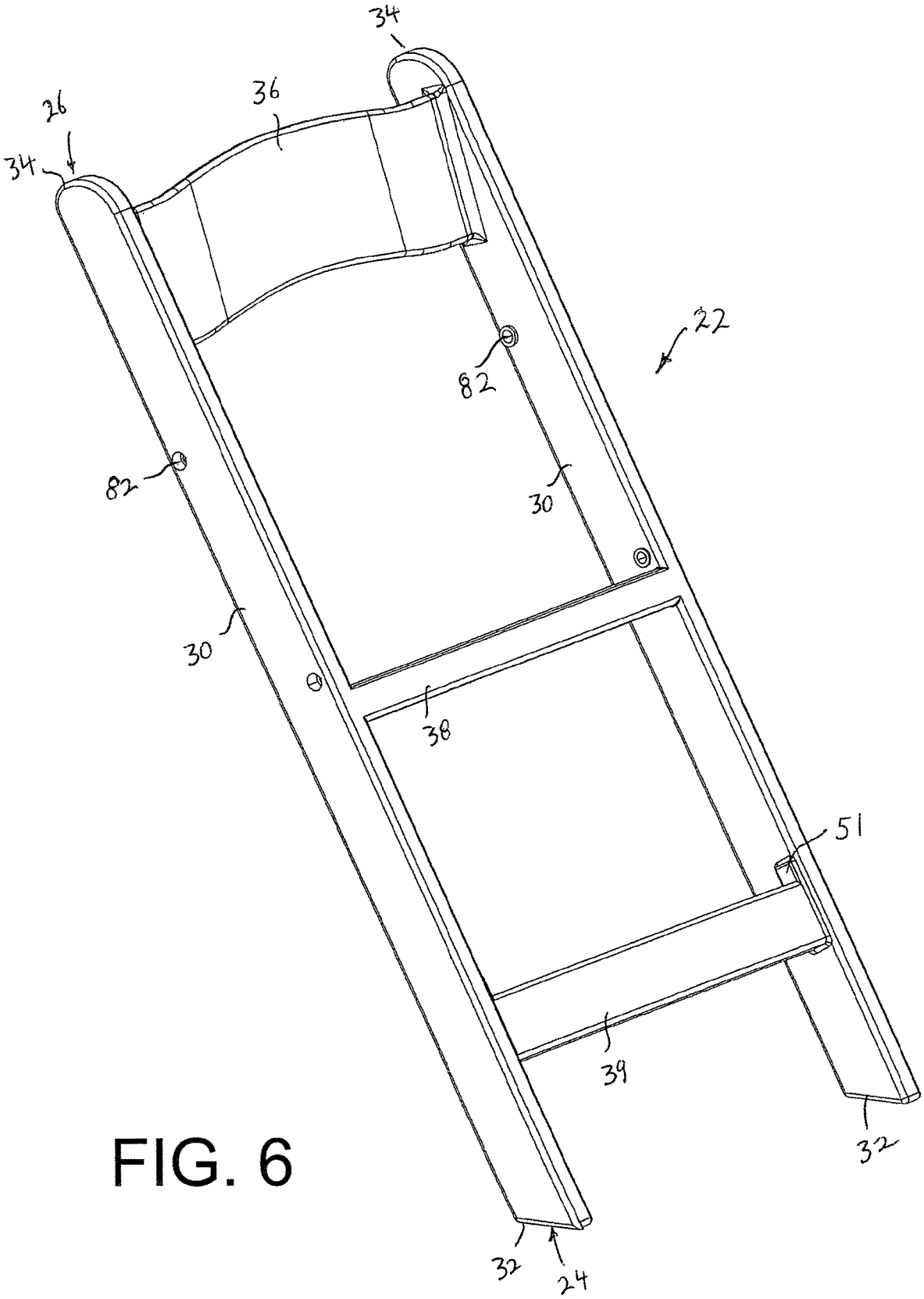
FIG. 6 is a front perspective view of the frame member of the chair.
Figure 7:
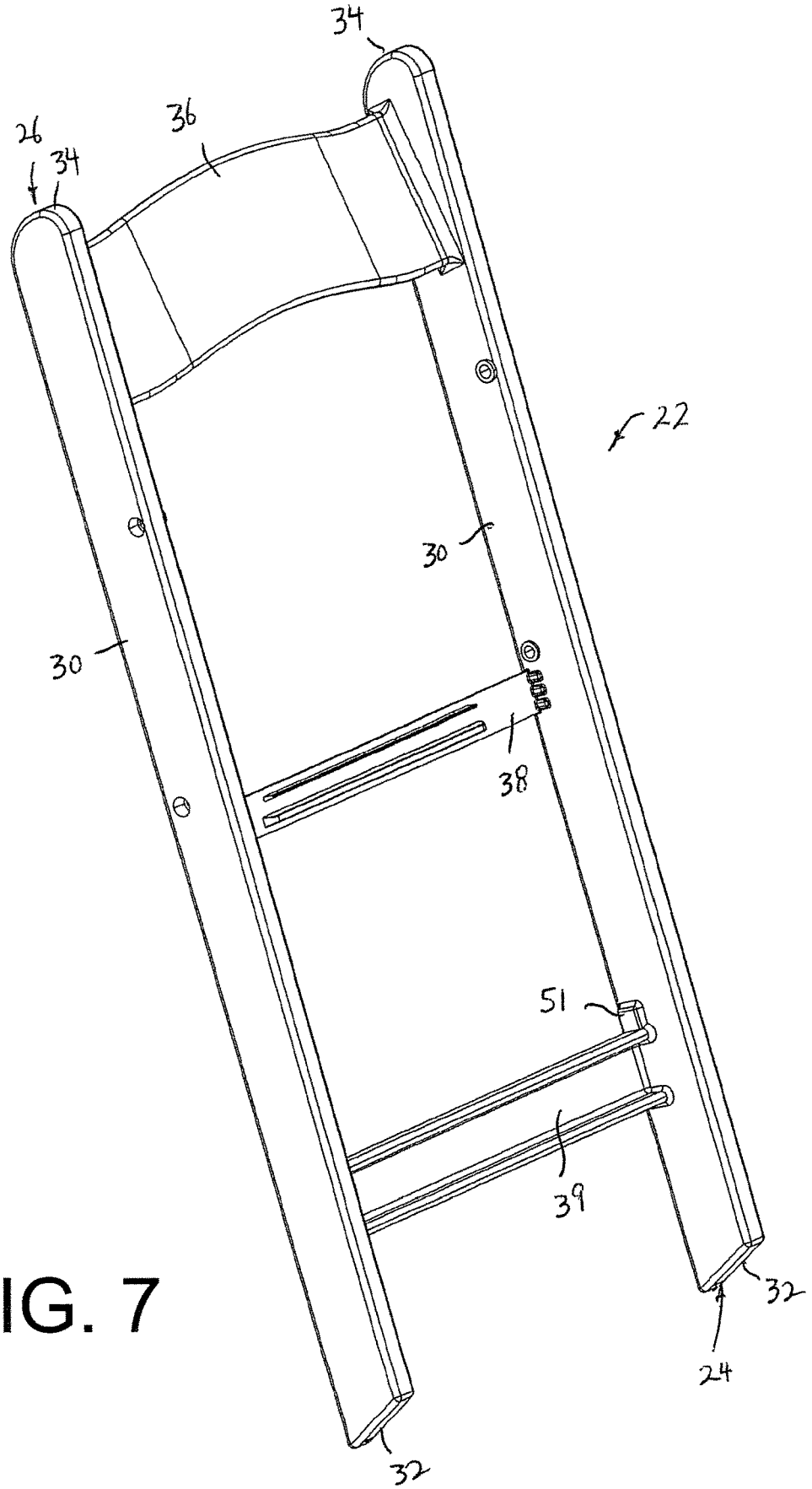
FIG. 7 is a rear perspective view of the frame member of the chair.

Referring to the drawings, and initially to FIGS. 1-3 thereof, a folding chair 20 of synthetic polymeric material constructed in accordance with the present invention is shown in an erected or opened configuration and includes a frame member 22 extending in a longitudinal direction between a base 24 and a longitudinally opposite top 26. Frame member 22 includes a pair of side rails 30 which extend longitudinally essentially parallel to one another and are spaced apart laterally from one another, each side rail 30 extending longitudinally between a basal end 32 at base 24 of frame member 22 and a top end 34 at top 26 of the frame member 22. A back rest 36 extends in lateral directions between and is connected to side rails 30, adjacent top ends 34 of side rails 30. A frame brace 38 extends laterally between side rails 30 intermediate basal end 32 and top end 34 of each side rail 30, and a basal brace 39 extends laterally between side rails 30 adjacent basal ends 32 of side rails 30.

Figure 9:
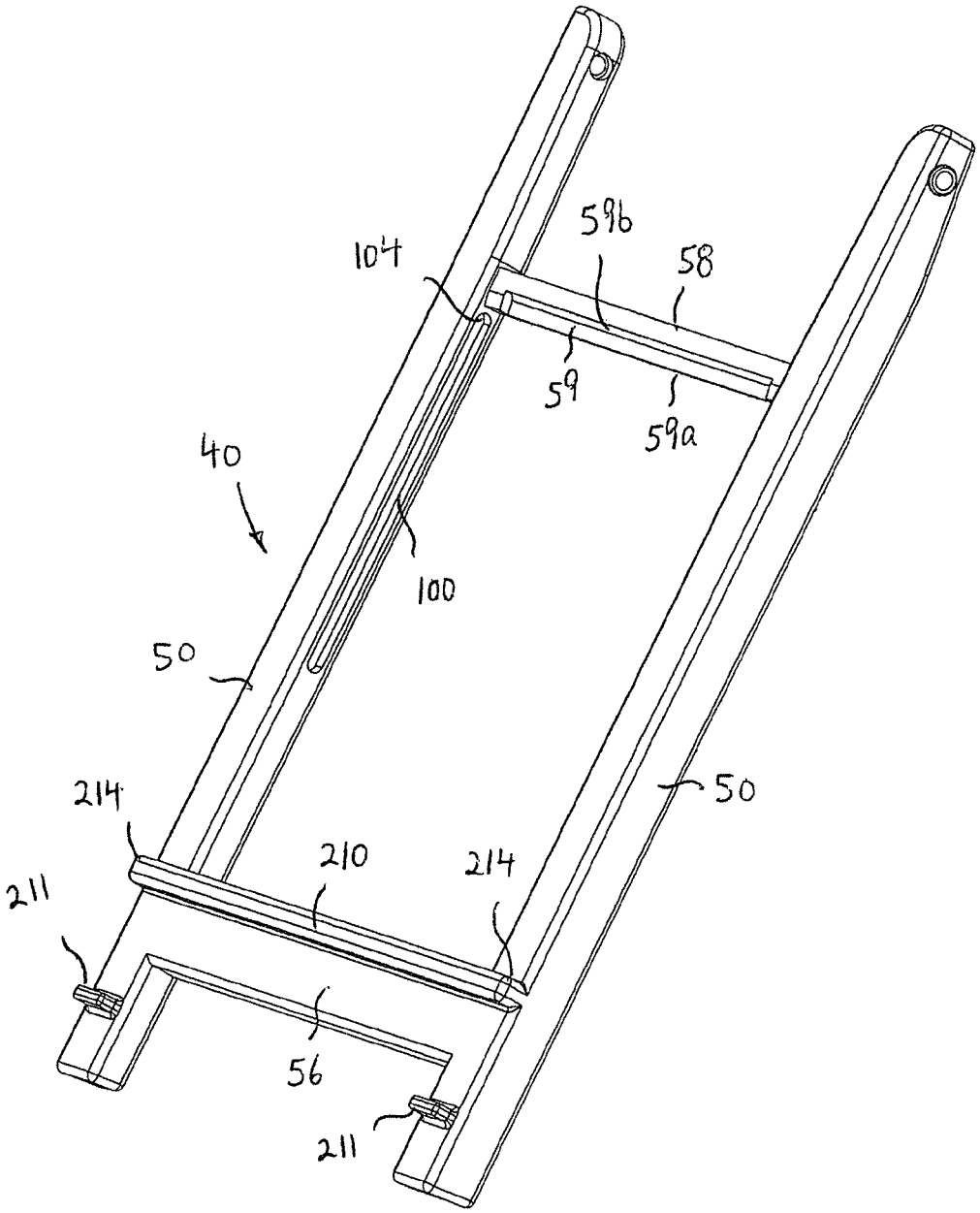
FIG. 9 is a rear perspective view of the support member of the chair.

A support member 40 extends in a longitudinal direction between a foot 42 and a longitudinally opposite head 44. A pair of side supports 50 extend longitudinally essentially parallel to one another and spaced apart laterally from one another, each side support 50 extending longitudinally between a foot end 52 at foot 42 of support member 40, and a head end 54 at head 44 of support member 40. A foot brace 56 extends laterally between side supports 50, adjacent foot end 52 of each side support 50, and a support brace 58 extends laterally between side supports 50 intermediate foot end 52 and head end 54 of each side support 50, but arranged closer to head end 54. Support brace 58 includes a cut-out recess 59 on the rear surface thereof, which is open at the lower end 59*a* thereof and which extends to about one-half the height of support brace 58, terminating at an upper shoulder 59*b* at the upper end thereof, as best shown in FIG. 9.

A seat member 60 has a generally square or rectangular shape, with a front section 62, a rear section 64 and two parallel, spaced apart, laterally opposite seat side sections 66 connecting together front section 62 and rear section 64, in surrounding relation to a square or rectangular opening 61 defined therein. Seat member 60 includes an upper seat surface 70 and an opposite lower undersurface 72.

Figure 10:
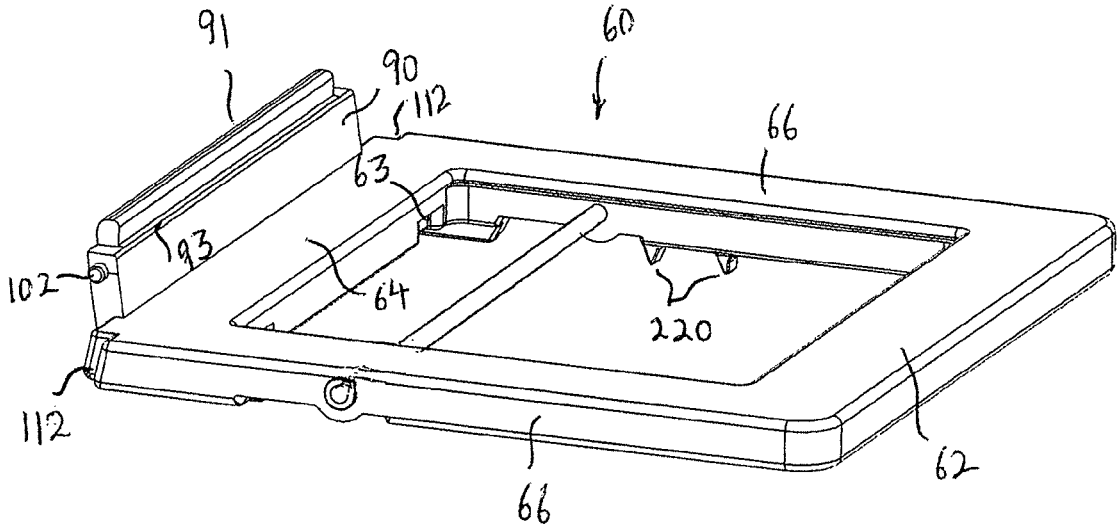
FIG. 10 is a top perspective view of the seat member of the chair.
Figure 11:
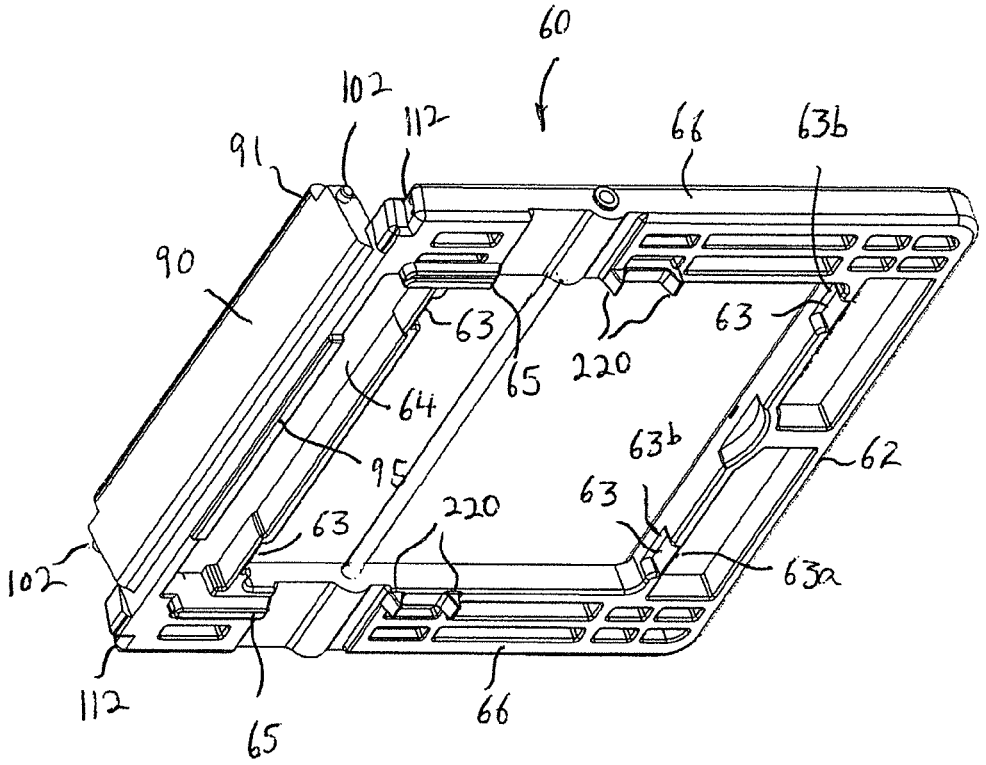
FIG. 11 is a bottom perspective view of the seat member of the chair.

The inner surface of front section 62 includes two spaced apart recesses 63, which are open at a lower end 63*a* thereof, and the inner surface of rear section 64 includes two spaced apart recesses 63, which are open at a lower end thereof, as best shown in FIGS. 10 and 11. Each recess 63 defines an upper shoulder 63*b* thereat.

Figure 12:
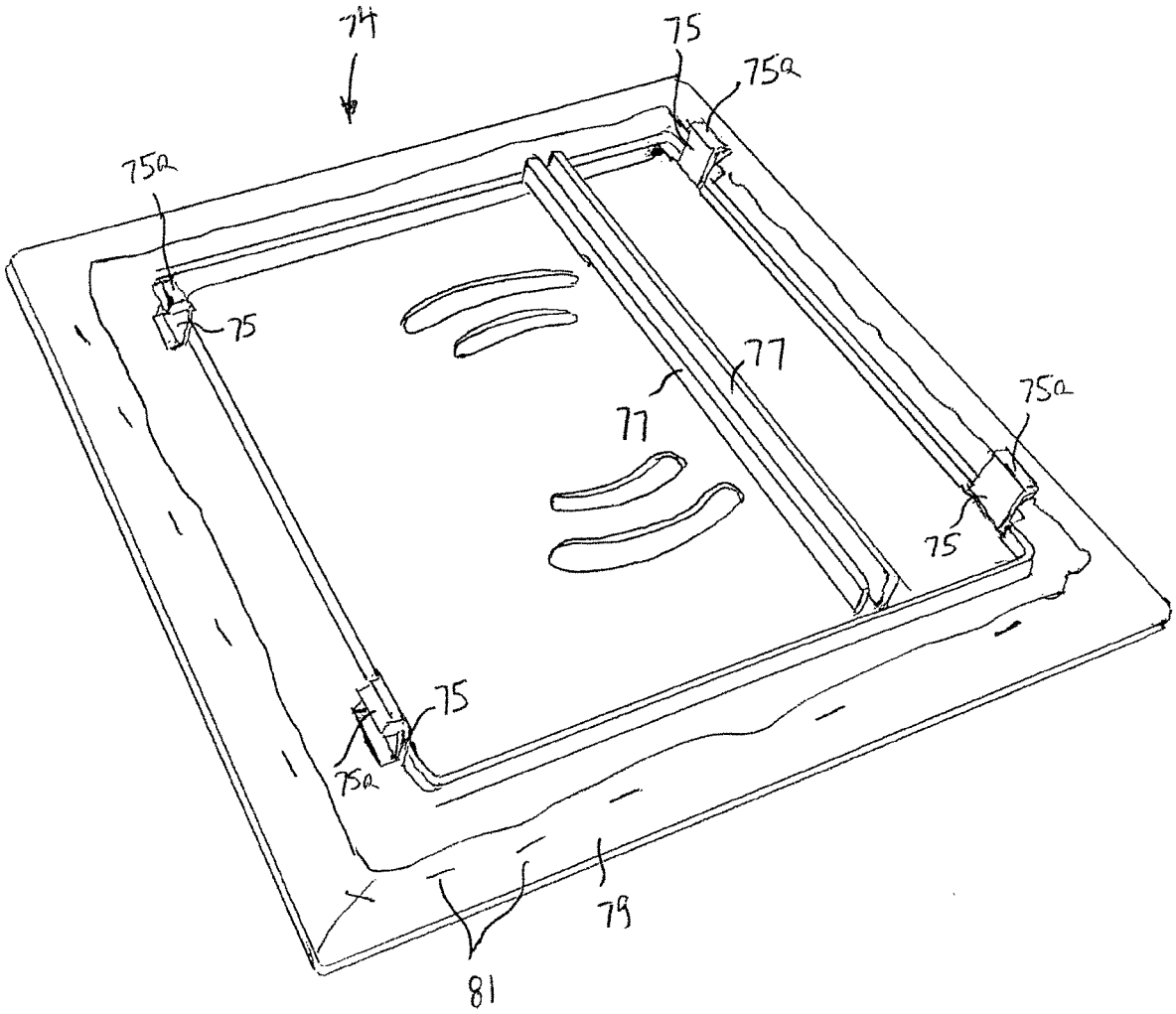
FIG. 12 is a perspective view of the underside of the seat cushion.

A seat cushion 74 (FIG. 12) is affixed to the seat member 60 at the upper seat surface 70 and provides a seat upon which a person may be seated with comfort and safety when chair 20 is in the erected or unfolded, open configuration shown in FIGS. 1-3.

Seat cushion 74 has a generally square or rectangular shape and sits on upper seat surface 70 of seat member 60 in covering relation to opening 61. Seat cushion 74 is made from a synthetic polymeric material and has four resilient catches 75 that extend downwardly from the lower surface thereof in positions corresponding to recesses 63, each catch 75 having a hook portion 75*a* at the free end thereof for extending through opening 61 and engaging within a respective recess 63, such that each hook portion 75*a* releasably locks with an upper shoulder 63*b*, to releasably secure seat cushion 74 on seat member 60. To remove seat cushion 74 from seat member 60, it is only necessary to apply an inwardly directed finger biasing force to each catch 75 to release the hook portion 75*a* thereof from the respective upper shoulder 63*b*.

In addition, two parallel, spaced apart walls 77 extend transversely along the lower surface of seat cushion 74, the purpose for which will be understood from the discussion hereafter.

Lastly, a cushion material 79 is positioned on the upper surface of seat cushion 74 and is draped over the lower surface of seat cushion 74 and secured thereto by staples 81.

Figure 13:
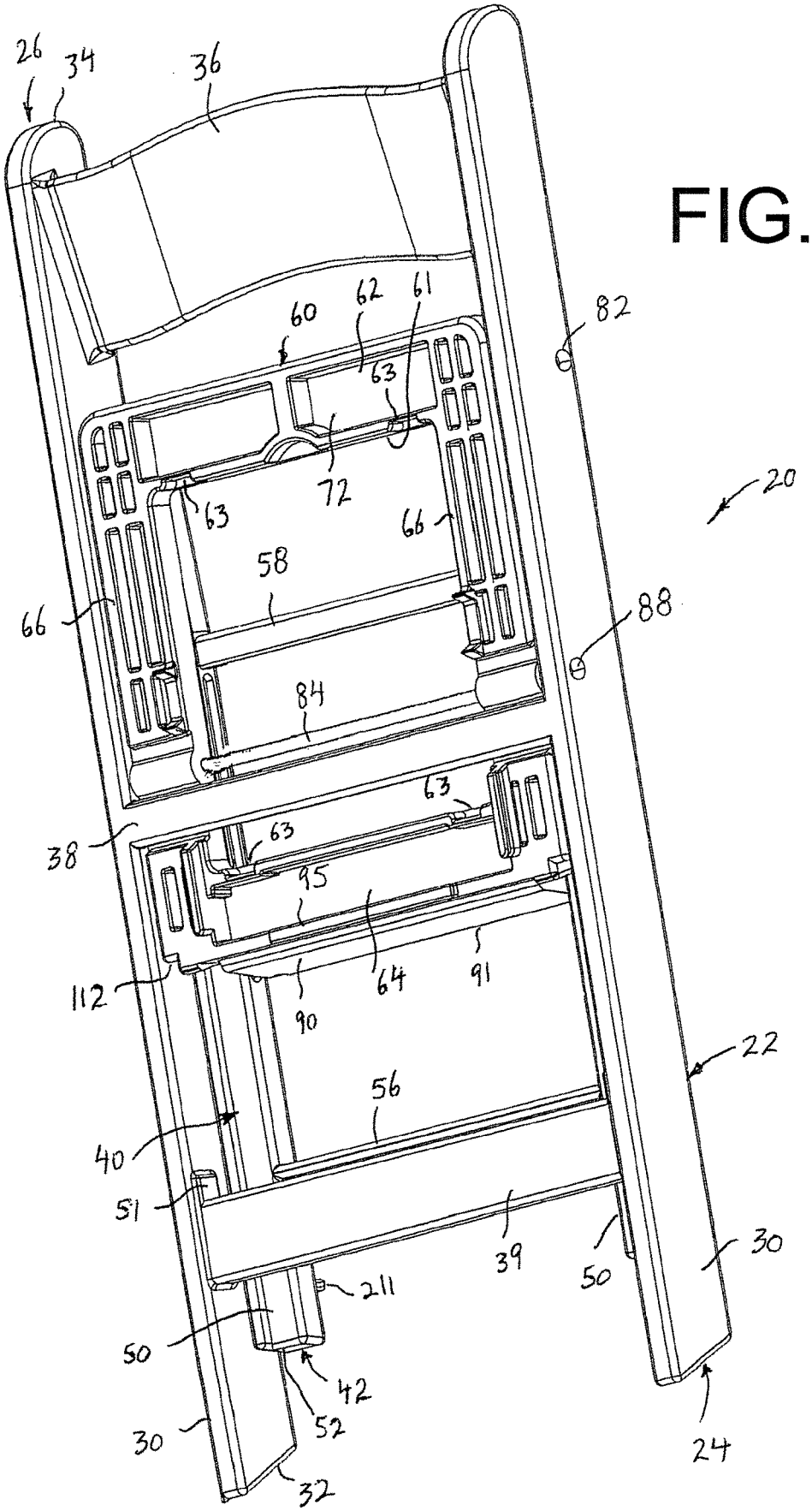
FIG. 13 is a front perspective view of the chair in a folded condition.
Figure 14:
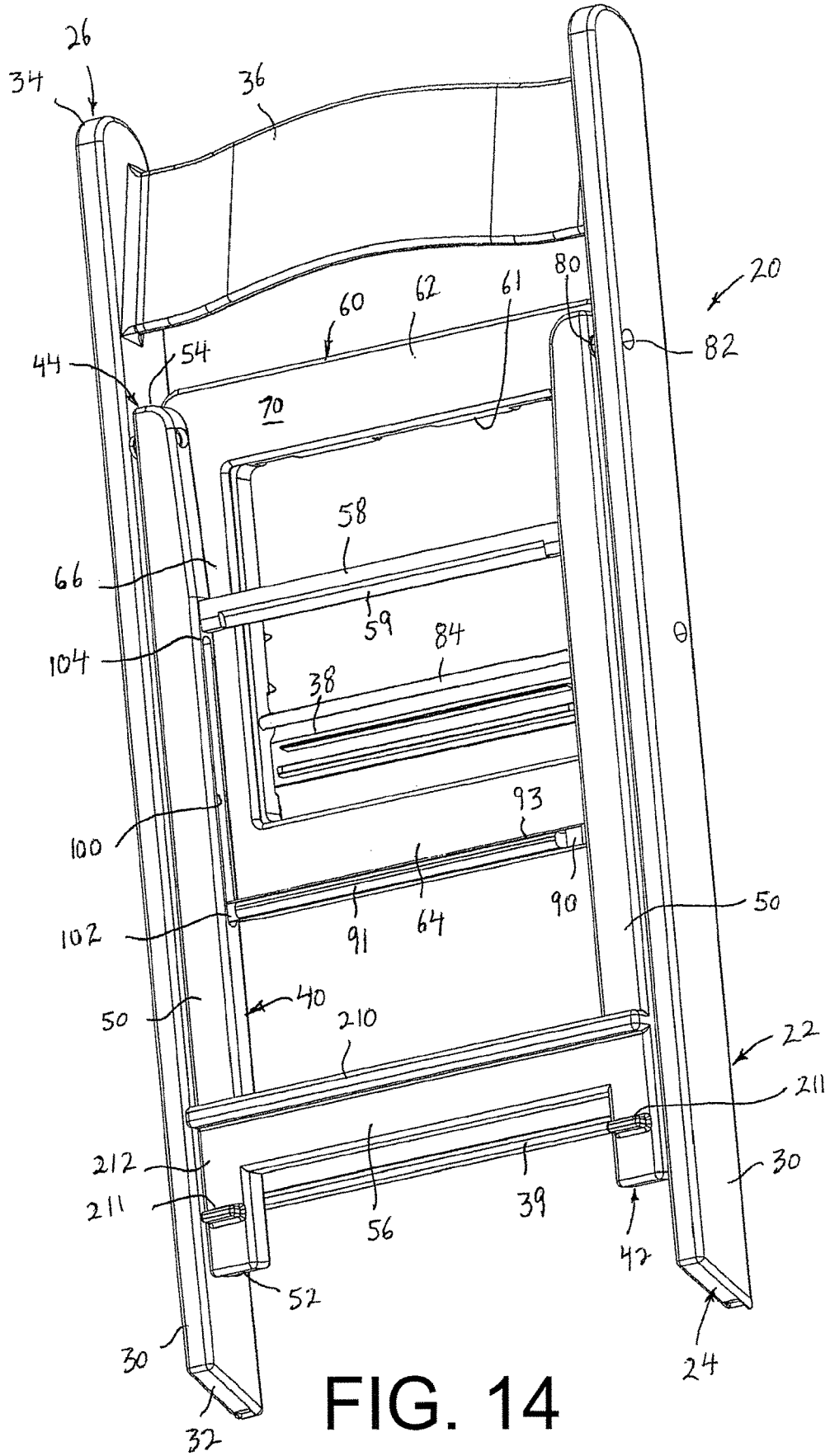
FIG. 14 is a rear perspective view of the chair in the folded condition.

Chair 20 is capable of being folded from the erected open configuration of FIGS. 1 and 2 into the folded configuration of FIGS. 13 and 14. To this end, a first pivotal mounting arrangement pivotally mounts support member 40 to frame member 22 for pivotal movement between the folded position shown in FIGS. 13 and 14 and the erected open position shown in FIGS. 1 and 2. The first pivotal mounting arrangement includes first pivots, each shown in the form of a pivot pin 80 placed at a first pivot location 82 adjacent head end 44 of each side support 50 and pivotally mounting a respective side support 50 to a corresponding side rail 30 at a position intermediate back rest 36 and frame brace 38 such that support member 40 is nested within frame member 22, between side rails 30, when in the folded position, as shown in FIGS. 13 and 14. Support member 40 makes an acute angle A with frame member 22 in the erect open configuration, to space foot ends 52 of side supports 50 transversely from corresponding basal ends 32 of side rails 30, thereby establishing a chair basal support configuration at 83 (FIG. 3).

A second pivotal mounting arrangement mounts seat member 60 to frame member 22, with seat member 60 extending laterally between side rails 30 of frame member 22, for movement between the extended open position shown in FIGS. 1-3 and a retracted folded position or closed position shown in FIGS. 13 and 14. The second pivotal mounting arrangement includes second pivots, shown in the form of a pivot rod 84 placed intermediate front section 62 and rear section 64 of seat member 60 and which spans seat member 60 between side sections 66 of seat member 60 to engage side rails 30 of frame member 22 at second pivot locations 88 juxtaposed with the frame brace 38 such that seat member 60 is pivotally mounted to side rails 30 at second pivotal locations 88 for being nested within frame member 22, laterally between side rails 30, when in the retracted folded position shown in FIGS. 13 and 14, and for extending in a generally horizontal seating position in the extended operative position, with undersurface 72 of the seat member 60 resting upon frame brace 38, as shown in FIGS. 1-3.

It will be appreciated that spaced apart walls 77 of seat cushion 74 engage pivot rod 84 therebetween when seat cushion 74 is secured on seat member 60.

A coupling arrangement couples rear section 64 of seat member 60 with support member 40 for securing seat member 60 in the extended open or operative position when chair 20 is erected, and for maintaining chair 20 in this open operative position, with support member 40 and frame member 22 at the angle A. The coupling arrangement includes a guide wall 90 having a generally rectangular parallelepiped shape, extending laterally across and upwardly from rear section 64 of seat member 60, such that guide wall 90 is positioned between side supports 50 at all times.

In order to provide for this arrangement, each side support 50 includes an elongated track recess 100 extending longitudinally along the inner wall of the respective side support 50, with track recesses 100 of side supports 50 facing each another. Guide wall 90 includes a cylindrical follower nub 102 projecting from each end of wall 90 and engaged within a corresponding track recess 100, riding up and down within the respective track recess 100 when chair 20 is moved between the open and folded configurations.

Guide wall 90 includes an extension component, namely, an extension wall 91 of a generally rectangular parallelepiped configuration, extending upwardly from the free end of guide wall 90 and extending outwardly past the plane of the rear surfaces of side supports 50 when the chair is in its folded condition. Extension wall 91 is slightly shorter than guide wall 90 as measured in the widthwise or transverse direction of chair 20. The rear surface of extension wall 91 is flush with, that is, coplanar with, the rear surface of guide wall 90, while the front surface of extension wall 91 is spaced slightly inwardly from the front surface of guide wall 90, so as to define a shoulder 93 at the connection of guide wall 90 with extension wall 91 at the front surfaces thereof.

Figure 8:
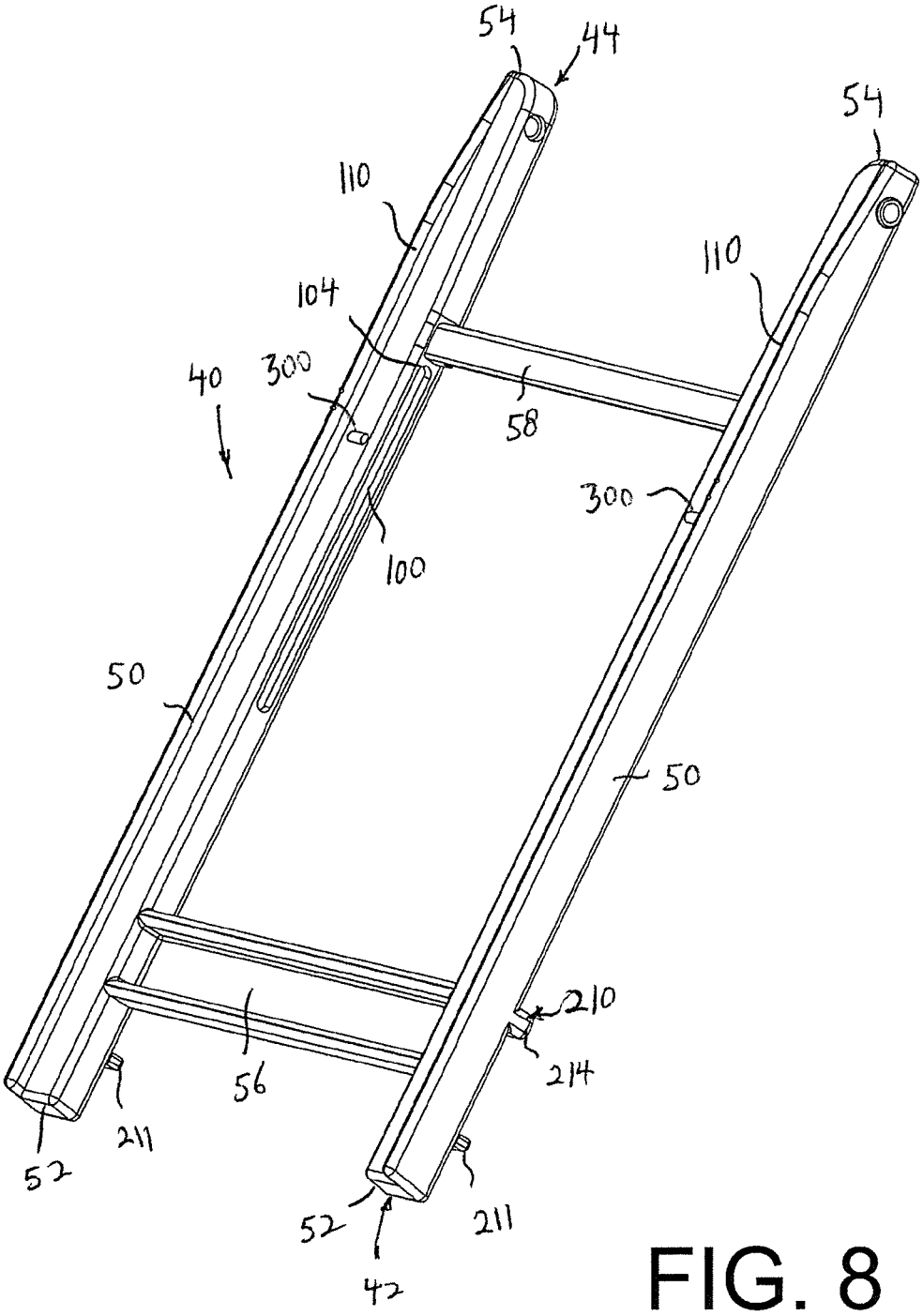
FIG. 8 is a front perspective view of the support member of the chair.

When chair 20 is moved to its open operative configuration, the upper end of extension wall 91 at the front surface thereof moves past the lower end 59*a* of cut-out recess 59, causing extension wall 91 to be positioned within cut-out recess 59 of support brace 58. The front surface of each side support 50 includes a slight rounded half-cylindrical projection 300, as best shown in FIG. 8. When extension wall 91 is moved into recess 59, the rear end of rear section 64 of rides over and snaps into position, and this functions to releasably lock folding chair 20 in its open operative configuration. In this configuration of folding chair 20, the upper edge of extension wall 91 is limited by shoulder 59*b*, and the undersurface 72 of seat member 60 rests on the upper surface of frame brace 38 which extends laterally between side rails 30.

It will be appreciated that prior known chairs locked the chairs in the open, operative configuration by a friction fit of extension wall 91 to recess 59. However, due to different tolerances in molding and due to wear, tear and warping over time, this may not align properly, making it difficult to open or close chair 20. The present invention does not provide such a friction fit, but rather, uses rounded projections 300 to lock the chair in the open, operative configuration, which makes opening and closing of the chair 20 much easier.

It is noted that each track recess 100 has an upper terminal end 104, and each terminal end 104 is spaced slightly away from the respective follower nub 102 engaged within track recess 100 when chair 20 is in the open operative configuration with a person seated on the fully extended seat member 60. As a result, engagement between each follower nub 102 and terminal end 104 of each track 100 is precluded, thereby assuring that stresses induced by the seating of a person on seat member 60 are not transmitted to follower nubs 102 and follower nubs 102 are protected against being damaged and even sheared from seat member 60 by such stresses.

Each side support 50 of the respective support member 40 has an L-shaped cross-sectional configuration providing a forwardly facing, reinforcing flange 110 along the length of the side support 50 for added support strength. Seat member 60 includes a notch 112 located at each intersection between the rear section 64 and the side sections 66 of seat member 60, and each notch 112 is complementary to a corresponding flange 110. When chair 20 is placed in the open operative configuration, each flange 110 is seated within a corresponding notch 112 to lend rigidity to chair 20, especially in lateral directions.

In the preferred construction of chair 20, each of frame member 22, support member 40 and seat member 60, is molded of a synthetic polymeric material, such as polypropylene, each being unitary for strength as well as for economy of manufacture. In order to conserve material and reduce weight, while still maintaining sufficient structural strength and the desired aesthetic appearance which simulates the appearance of a traditional wooden folding chair, at least frame member 22 and support member 40 preferably are formed of hollow structural elements as shown in U.S. Pat. No. 6,890,026.

For increased strength and safety, pivot pins 80 and pivot rod 84 are constructed of a high-strength material, such as steel, and extend through side rails 30, with pivot pins 80 extending through side supports 50, and pivot rod 84 extending through the seat member 60, as described above.

As with U.S. Pat. No. 6,890,026, chair 20 is constructed for ready stacking with like chairs 20, when in the folded configuration. However, in order to prevent sliding movement of the stacked chairs, a restraining system is required.

As with U.S. Pat. No. 6,890,026, folding chair 20 herein includes an elongated first stacking rib 210 extending rearwardly from the upper portion of foot brace 56 of support member 40 and extending along the length thereof and also extending to a position to the rear of side supports 50 and connected therewith. Thus, stacking rib 210 extends almost the entire width of folding chair 20.

Figure 16:
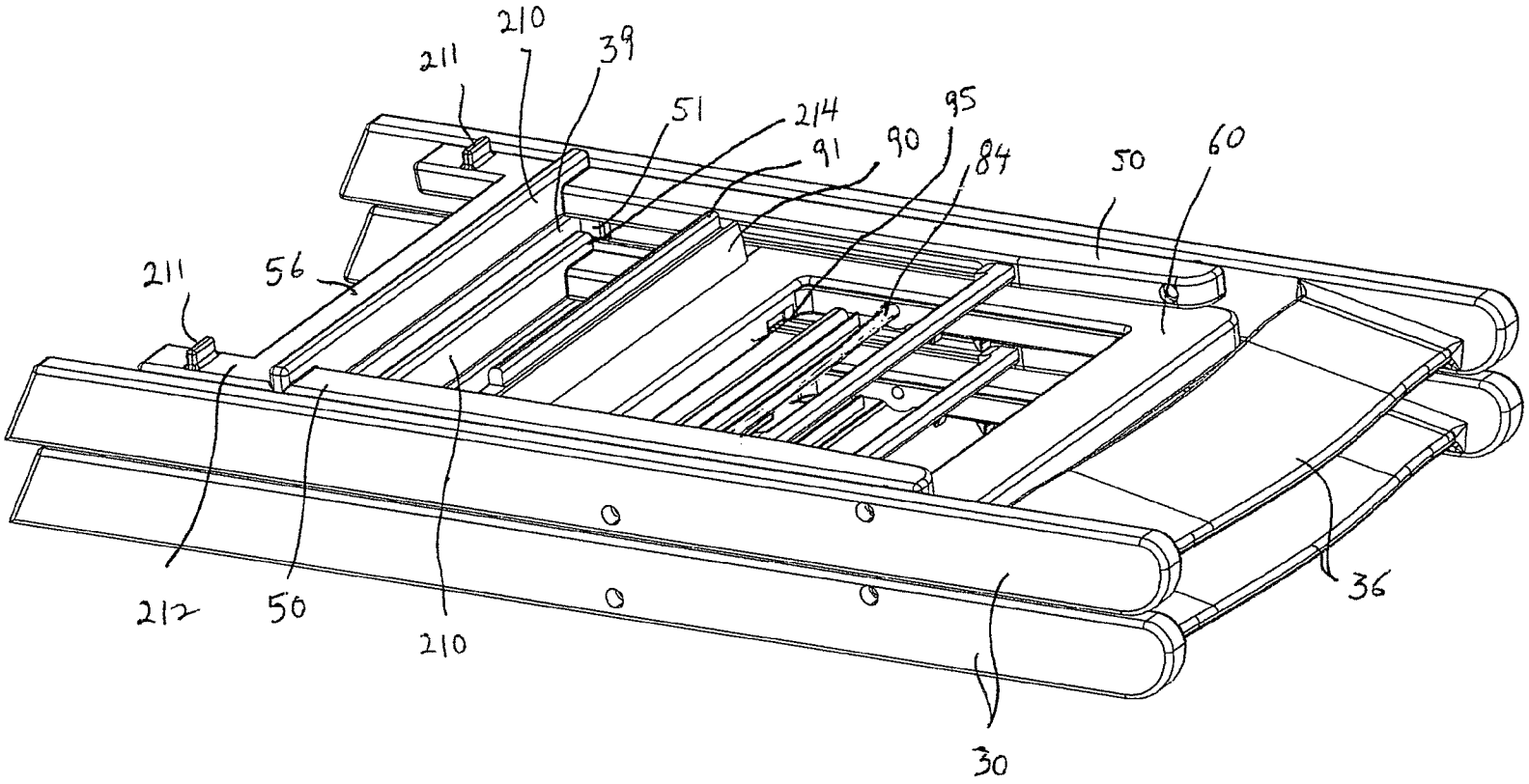
FIG. 16 is a perspective view of two chairs stacked upon one another.

Stacking rib 210 is preferably molded integrally as one piece with foot brace 56 and side supports 50. Thus, stacking rib 210 projects from foot brace 56 in an orthogonal direction to the rear of foot brace 56, and extends rearwardly of side supports 50, for juxtaposition with the upper edge of basal brace 39 of the next adjacent chair 20 in the stack, as shown in FIG. 16. This functions to restrict sliding movement of the upper chair 20 of the stack in a direction toward top 26 of the lower chair on which the upper chair 20 is stacked.

It is noted that, as described at column 10, lines 20-34 of in U.S. Pat. No. 6,890,026, it was necessary to provide a laterally extending slot in basal brace 39, as well as opposed shoulders at the ends of the slots at the inner surface of each side rail 30 immediately above the respective basal brace 39 for receiving ends of the stacking rib 210. The problem with this arrangement is that it makes construction more difficult, and limits stacking only to chairs of the same type show in U.S. Pat. No. 6,890,026.

In the present invention, the slot within basal brace 39 as well as corresponding shoulders at the ends of the slot for receiving ends of the stacking rib 210, are eliminated.

Rather, in place thereof, a second stacking rib 211 extends outwardly from the rear surface of each side support 50 at a position below and spaced from elongated stacking rib 210.

Figure 17:
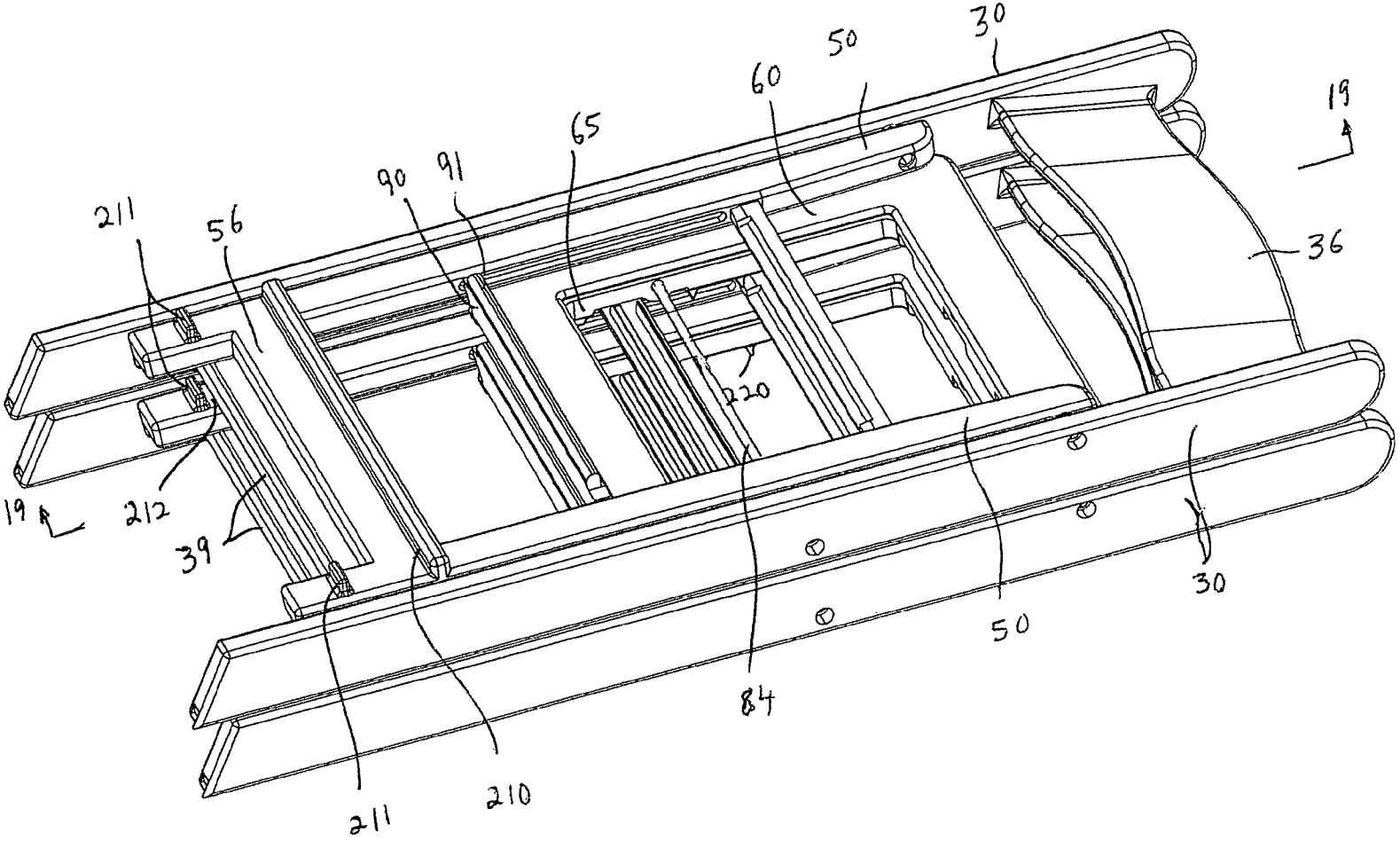
FIG. 17 is a perspective view of two chairs stacked upon one another from a different angle.
Figure 18:
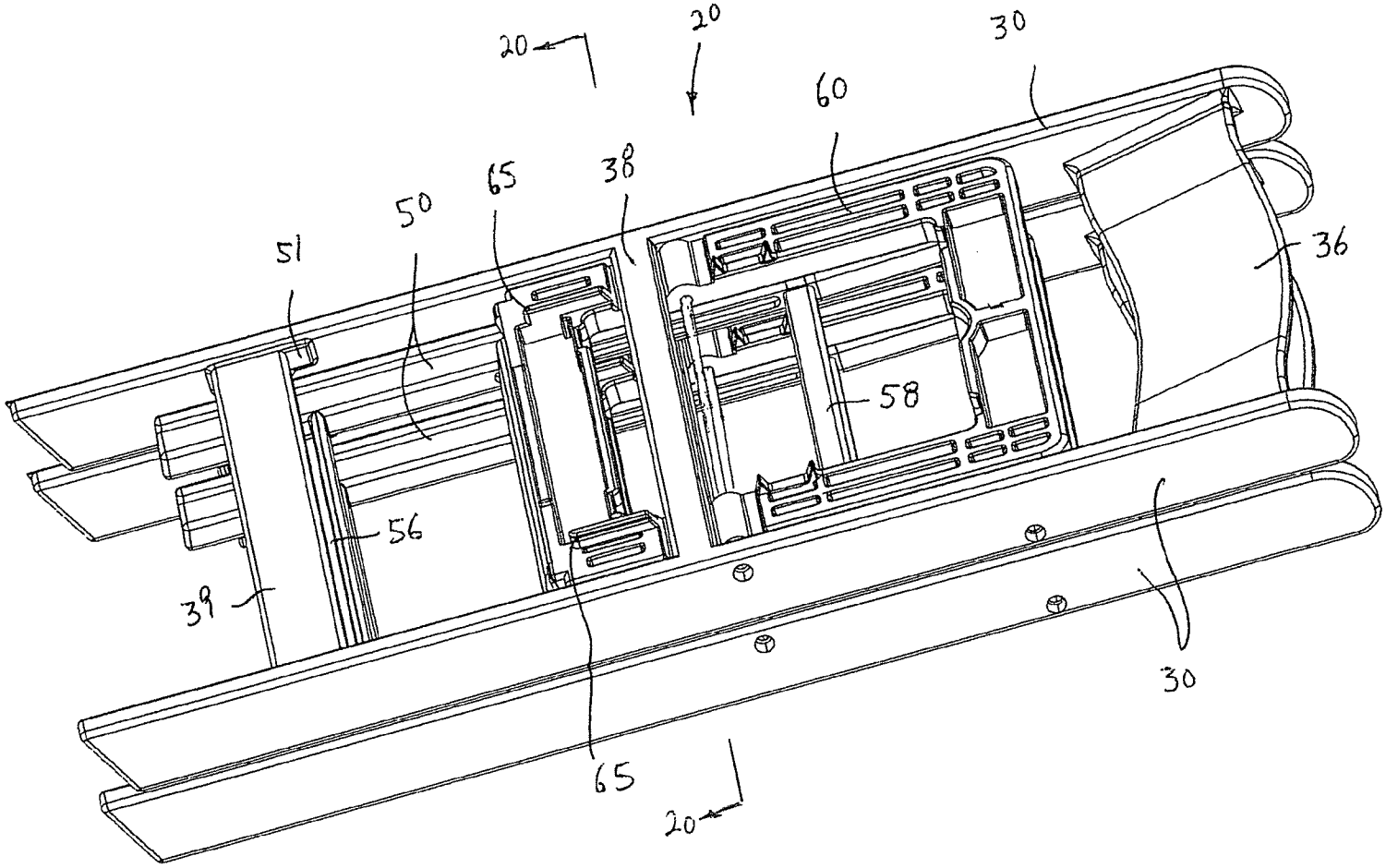
FIG. 18 is a perspective view of two chairs stacked upon one another.

With such arrangement, when one chair 20 is stacked upon another chair 20, the basal brace 39 of the upper chair 20 fits in a gap 212 between first elongated stacking rib 210 and second stacking ribs 211, as shown in FIGS. 16 and 17. As a result, sliding movement of the upper chair 20 in the longitudinal direction, upwardly or downwardly, on the lower chair 20 is prevented.

More importantly, since most folding chairs of this type include a basal brace 39 at the same position, even if other elements of the chairs are different, the present invention provides more universal stacking of different manufactures or constructions of folding chairs.

Figure 15:
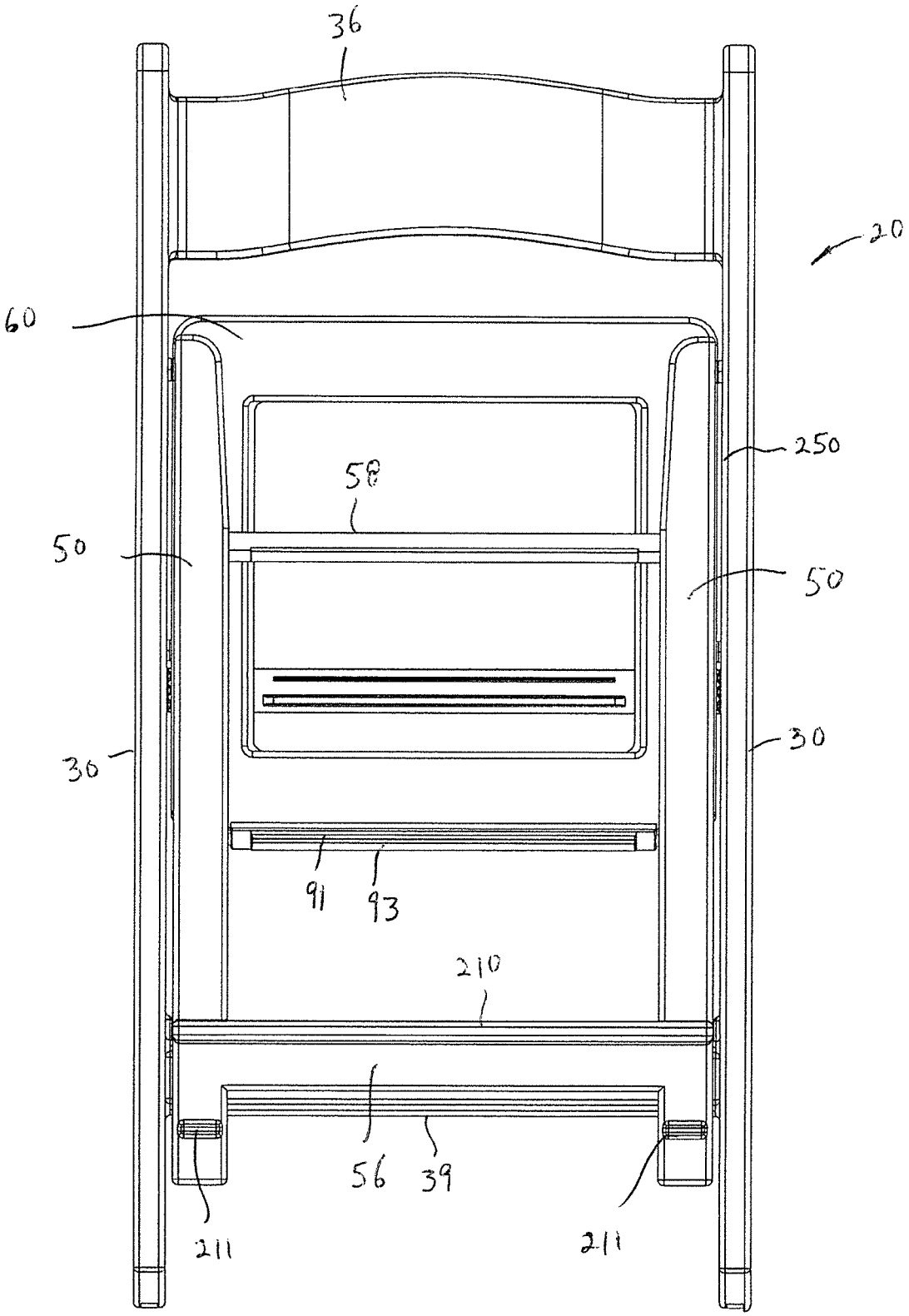
FIG. 15 is a plan view of the chair in the folded configuration.

Further, because there is a gap or space 250 between the outer surfaces of side supports 50 and the inner surfaces of side rails 30, as best shown in FIG. 15, each chair 20 further includes an inwardly facing raised boss 51 at the inner surface of each side support 50 at a position immediately above basal brace 39, such that, in a stacking arrangement of chairs 20, the elongated stacking rib 210 of another stacked chair 20 fits between inwardly facing raised bosses 51 with opposite rib ends 214 of the stacking rib 210 in very close proximity to raised bosses 51, as shown in FIG. 16, with very little play, to prevent lateral or transverse movement of the stacked chairs 20 relative to each other. In such case, the rib ends 214 of elongated stacking rib 210 of one chair 20 will be positioned immediately adjacent raised bosses 51 of another stacked chair.

It will be appreciated that first elongated stacking rib 210 can be replaced with two first stacking ribs extending outwardly only from the rear surface of each side support 50 at a position above and spaced from second stacking ribs 211, which would be sufficient to trap the basal brace 39 of a stacked chair therein.

Figure 19:
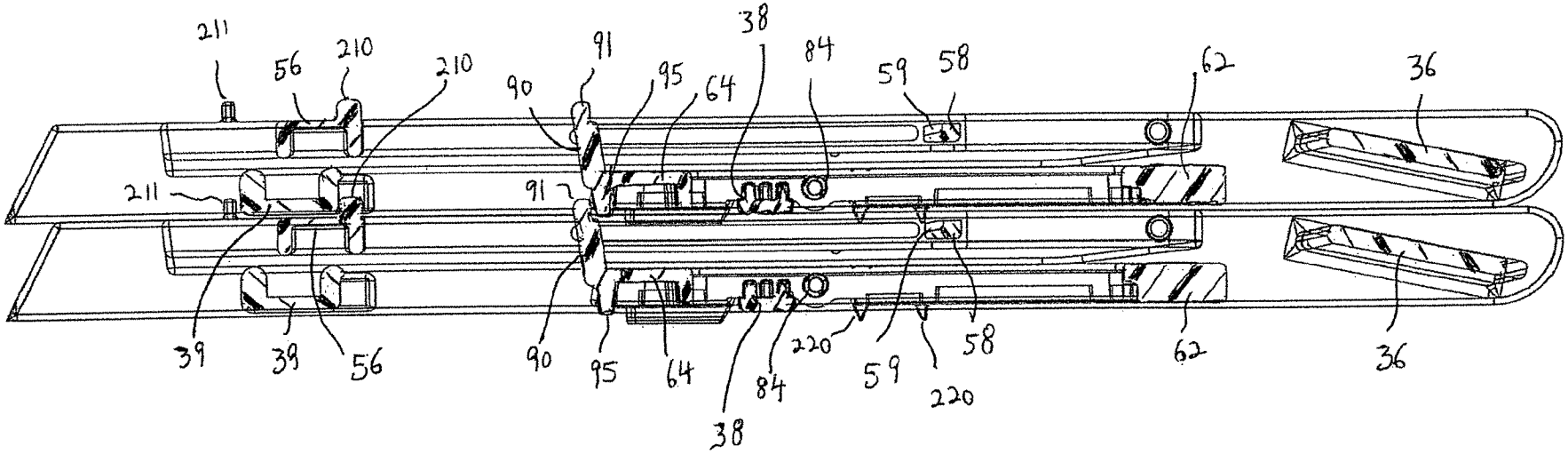
FIG. 19 is a longitudinal cross-sectional view of the two stacked chairs of FIG. 17, taken along line 19-19 thereof.
Figure 20:
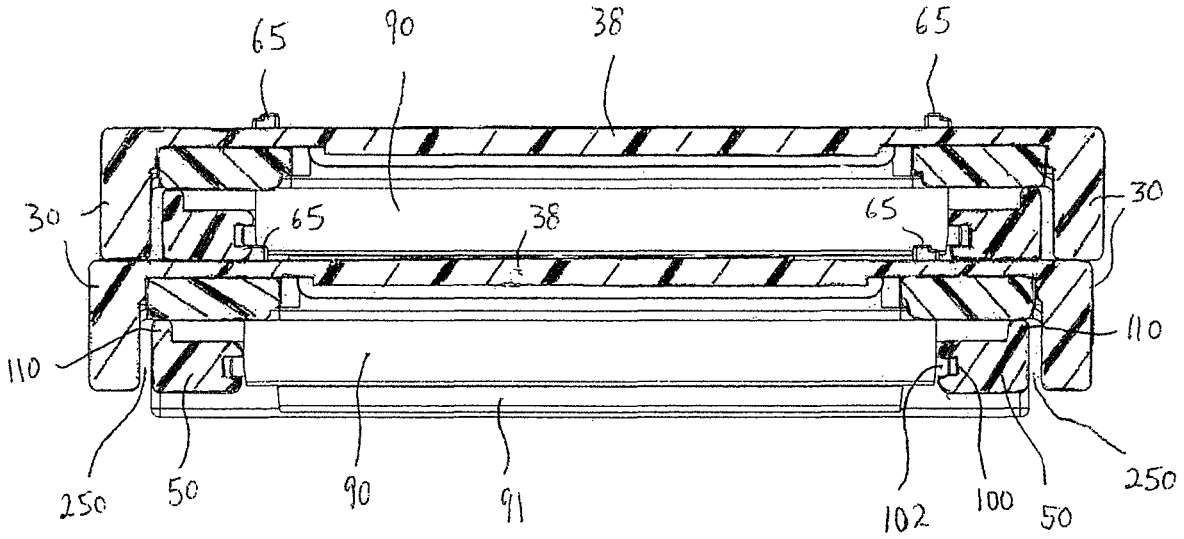
FIG. 20 is a longitudinal cross-sectional view of the two stacked chairs of FIG. 18, taken along line 20-20 thereof.

In addition, in accordance with another important aspect of the present invention, a restraining bar 95 extends downwardly from rear section 64 of seat member 60 at a position slightly forwardly of extension bar 91 and is molded integrally with rear section 64. In this manner, when folded chairs 20 are stacked upon one another, restraining bar 95 is in abutment with and hugs the forward facing surface of extension bar 91 of the next lower chair in the stack, with the free end of restraining bar 95 being limited by shoulder 93, as best shown in FIG. 19.

As such, extension bar 91 has a two-fold function, that is, releasably fixing the chair in the unfolded, open or operative position, as well as engaging with restraining bar 95 when stacked with other chairs in the folded position.

With this arrangement, not only are the chairs restricted in longitudinal movement relative to each other due to basal brace 39 of the upper chair 20 fitting between first elongated stacking rib 210 and second stacking ribs 211, but also, by engagement of restraining bar 95 of one chair with extension bar 91 of the next stacked chair 20.

In this manner, because of the above arrangements, relative longitudinal movement of the stacked chairs relative to each other is prevented, not only for chairs 20 of this identical type but for stacking with a wide range of other folding chairs of different constructions.

With the present invention, relative movement of the stacked chairs in the transverse direction is also prevented.

In order to further restrict such lateral or transverse movement between stacked chairs 20, restraining fingers 65 extend outwardly (downwardly) from the undersurface of laterally opposite seat side sections 66 of each seat member 60, each restraining finger 65 extending in the lengthwise direction of seat side sections 66 at an inner portion thereof and immediately adjacent rear section 64.

When chairs 20 are stacked one upon another, restraining fingers 65 fit within and are positioned immediately adjacent and in juxtaposition to inner surfaces of side supports 50 of the next stacked chair 20, to prevent lateral or transverse relative movement between the stacked chairs.

It will be appreciated that, because the widths of folding chairs of this type are generally the same, elongated stacking rib 210 and restraining fingers 65 function to prevent lateral or transverse relative movement between the present folding chair 20 and other widely sold folding chairs.

In addition to the above arrangement, each chair 20 includes two pair of spaced apart stacking fingers 220 molded integral with seat member 60 and projecting from the undersurface 72 of the seat member 60 in an orthogonal direction, relative to the longitudinal and lateral directions set forth above, to extend beyond the rear surface of side supports 50 of the respective chair 20.

Preferably, stacking fingers 220 extend outwardly in the lateral direction a smaller distance than restraining fingers 65 so as to better stack with chairs of different configurations. However, stacking fingers 220 may extend outwardly in the lateral direction to the same extent as restraining fingers 65 so as to prevent lateral movement between stacked chairs 20, that is, stacking fingers 220 fit within and are positioned immediately adjacent and in juxtaposition to inner surfaces of side supports 50 of the next stacked chair 20, to prevent lateral or transverse relative movement between the stacked chairs.

In addition, as shown best in FIG. 1, one stacking finger 220 on each side engages the front facing surface of frame brace 38 in the open, operative configuration, which provides greater structural rigidity of the chair and can permit up to 950 pounds pressure in a static load test, to prevent breaking of the chair when a person sits thereon.

Further, since there are two spaced apart stacking fingers 220 on each side, a support brace 58 of prior known chairs will fit therebetween to prevent longitudinal movement of the stacked chairs.

In this manner, a uniform, compact stack of folding chairs of different types is formed easily and is conveniently and effectively stabilized for facilitating storage and transportation of the folding chairs in the folded configuration.

It will be seen that the present invention attains all of the objects and advantages summarized above, namely: provides a folding chair constructed for ready manufacture of a synthetic polymeric material, while simulating closely the aesthetic appearance and seating comfort of previous folding chairs constructed of wood; provides folding chairs of synthetic polymeric materials constructed to conserve material and weight while attaining enhanced strength, comfort and safety, as well as a desired aesthetic appearance; militates against injury to a seated person or damage to a seated person's clothing; prevents damage to like chairs which otherwise could result from contact among such like chairs, either when arranged at the site of a function or when stacked for storage and transportation; enables effective stacking, when folded, in stable, compact and uniform stacks for ready storage and transportation; provides folding chairs of increased strength and durability, while more closely simulating the aesthetic appearance of traditional wooden folding chairs; facilitates the operation of a folding chair for increased ease of erection and folding; enables the economical manufacture of folding chairs requiring less maintenance over an increased service life.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention.

What is claimed is:

1. A folding chair for movement between a folded condition and an unfolded erect condition, comprising:

a frame member extending in a frame member lengthwise direction between a base and an opposite top, the frame member including:

a pair of side rails extending in parallel, spaced apart relation in said lengthwise direction, each side rail extending longitudinally between a basal end at the base of the frame member and a top end at the top of the frame member, a back rest extending in a lateral direction between the side rails, adjacent the top ends of the side rails, the back rest connected at opposite ends thereof with the side rails, a basal brace extending in said lateral direction between the side rails adjacent the basal ends of the side rails, and a frame brace extending laterally between the side rails intermediate the basal end and the top end of each side rail;

a support member extending in a support member lengthwise direction thereof between a foot and an opposite head, the support member including:

a pair of side supports extending in parallel, spaced apart relation in said support member lengthwise direction, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect unfolded position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member including a front section, a rear section and opposite seat side sections extending between and connected to the front and rear sections, the seat member having a seat surface and an opposite undersurface;

a second pivotal mounting arrangement mounting the seat member to the frame member, with the seat member positioned between the side rails of the frame member, for movement between a retracted position and an extended position, the second pivotal mounting arrangement including a second pivot placed intermediate the front section and the rear section of the seat member and pivotally mounting the seat member to the side rails at a second pivotal location juxtaposed with the frame brace such that the seat member is nested within the frame member, laterally between the side rails, when in the retracted position corresponding to the folded position, and the undersurface of the seat member rests upon the frame brace when in the extended position corresponding to the erect unfolded position;

a coupling arrangement coupling the rear section of the seat member with the support member for securing the seat member in the extended position when the chair is in the erect unfolded position;

at least one first stacking rib extending along and projecting orthogonally from one of:

a rear surface of the foot brace, rear surfaces of the side supports, or both the rear surface of the foot brace and the rear surfaces of the side supports, at a position adjacent the foot of the support member; and second stacking ribs extending along and projecting orthogonally from the rear surfaces of the side supports in spaced apart relation from the at least one first stacking rib, to define a gap between the at least one first stacking rib and the second stacking ribs, for receiving the basal brace of another chair stacked thereon, to preclude relative movement between the stacked chairs in longitudinal directions thereof, whereby the stacked chairs establish a uniform stable stack of like chairs.

2. A folding chair according to claim 1, wherein said at least one first stacking rib includes a single stacking rib extending along and projecting orthogonally from both the rear surface of the foot brace and the rear surfaces of the side supports.

3. A folding chair between a folded condition and an unfolded erect condition, comprising:

a frame member extending in a frame member lengthwise direction between a base and an opposite top, the frame member including:

a pair of side rails extending in parallel, spaced apart relation in said lengthwise direction, each side rail extending longitudinally between a basal end at the base of the frame member and a top end at the top of the frame member, a back rest extending in a lateral direction between the side rails, adjacent the top ends of the side rails, the back rest connected at opposite ends thereof with the side rails, a basal brace extending in said lateral direction between the side rails adjacent the basal ends of the side rails, and a frame brace extending laterally between the side rails intermediate the basal end and the top end of each side rail;

a support member extending in a support member lengthwise direction thereof between a foot and an opposite head, the support member including:

a pair of side supports extending in parallel, spaced apart relation in said support member lengthwise direction, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect unfolded position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member including a front section, a rear section and opposite seat side sections extending between and connected to the front and rear sections, the seat member having a seat surface and an opposite undersurface a second pivotal mounting arrangement mounting the seat member to the frame member, with the seat member positioned between the side rails of the frame member, for movement between a retracted position and an extended position, the second pivotal mounting arrangement including a second pivot placed intermediate the front section and the rear section of the seat member and pivotally mounting the seat member to the side rails at a second pivotal location juxtaposed with the frame brace such that the seat member is nested within the frame member, laterally between the side rails, when in the retracted position corresponding to the folded position, and the undersurface of the seat member rests upon the frame brace when in the extended position corresponding to the erect unfolded position;

a coupling arrangement coupling the rear section of the seat member with the support member for securing the seat member in the extended position when the chair is in the erect unfolded position, the coupling arrangement including a guide wall extending upwardly from the rear section of the seat member, said guide wall including an extension wall extending outwardly from the guide wall and past the plane of rear surfaces of the side supports when the chair is in its folded condition, for releasably engaging with the support brace in the unfolded erect condition of the chair to releasably retain the chair in the unfolded erect condition; and a restraining bar extending downwardly from the rear section of the seat member for engaging with the extension wall of another chair when the chairs are provided one on top of another in a stacked relation, to preclude relative movement between the stacked chairs in longitudinal directions thereof, whereby the stacked chairs establish a uniform stable stack of like chairs.

4. A folding chair according to claim 3, wherein the extension wall extends upwardly from a free end of the guide wall and is shorter than the guide wall, as measured in the transverse direction of the chair, the extension wall having a front surface spaced slightly inwardly from the front surface of the guide wall, so as to define a shoulder at the connection of the guide wall with the extension wall at the front surfaces thereof, such that the support brace of another stacked chair thereon engages the front surface of the extension wall, and is limited by the shoulder.

5. A folding chair according to claim 4, wherein the extension wall has a rear surface which is coplanar with a rear surface of the guide wall.

6. A folding chair according to claim 3, wherein each side support of the support member includes a track confronting a corresponding side of the seat member; and the seat member includes a follower projecting from each side of the seat member and engaged with a corresponding track for effecting simultaneous movement of the seat member between the retracted position and the extended position of the support member between the folded position and the erect position, the terminal end of each track confronting and spaced away from a corresponding follower when the seat member is in the unfolded erect position so as to preclude engagement of the follower with the terminal end when the seat member is in the erect position.

7. A folding chair according to claim 3, wherein the followers project from ends of the guide wall.

8. A folding chair according to claim 3, further comprising:

at least one first stacking rib extending along and projecting orthogonally from one of:

a rear surface of the foot brace, rear surfaces of the side supports, or both the rear surface of the foot brace and the rear surfaces of the side supports, at a position adjacent the foot of the support member; and second stacking ribs extending along and projecting orthogonally from the rear surfaces of the side supports in spaced apart relation from the at least one first stacking rib, to define a gap between the at least one first stacking rib and the second stacking ribs, for receiving the basal brace of another chair stacked thereon, to preclude relative movement between the stacked chairs in longitudinal directions thereof, whereby the stacked chairs establish a uniform stable stack of like chairs.

9. A folding chair according to claim 8, wherein said at least one first stacking rib includes a single stacking rib extending along and projecting orthogonally from both the rear surface of the foot brace and the rear surfaces of the side supports.

10. A folding chair for movement between a folded condition and an unfolded erect condition, comprising:

a frame member extending in a frame member lengthwise direction between a base and an opposite top, the frame member including:

a pair of side rails extending in parallel, spaced apart relation in said lengthwise direction, each side rail extending longitudinally between a basal end at the base of the frame member and a top end at the top of the frame member, a back rest extending in a lateral direction between the side rails, adjacent the top ends of the side rails, the back rest connected at opposite ends thereof with the side rails, a basal brace extending in said lateral direction between the side rails adjacent the basal ends of the side rails, and a frame brace extending laterally between the side rails intermediate the basal end and the top end of each side rail;

a support member extending in a support member lengthwise direction thereof between a foot and an opposite head, the support member including:

a pair of side supports extending in parallel, spaced apart relation in said support member lengthwise direction, each side support extending longitudinally between a foot end at the foot of the support member and a head end at the head of the support member, a foot brace extending laterally between the side supports adjacent the foot end of each side support and a support brace extending laterally between the side supports intermediate the foot end and the head end of each side support;

a first pivotal mounting arrangement mounting the support member to the frame member for pivotal movement of the support member between a folded position and an erect unfolded position, the first pivotal mounting arrangement including a first pivot placed at a first pivot location adjacent the head end of each side support and pivotally mounting a respective side support to a corresponding side rail intermediate the back rest and the frame brace such that the support member is nested within the frame member, between the side rails, when in the folded position, and the support member makes an acute angle with the frame member, to space the foot ends of the side supports transversely from corresponding basal ends of the side rails, thereby establishing a chair basal support configuration when in the erect position;

a seat member including a front section, a rear section and opposite seat side sections extending between and connected to the front and rear sections, the seat member having a seat surface and an opposite undersurface;

a second pivotal mounting arrangement mounting the seat member to the frame member, with the seat member positioned between the side rails of the frame member, for movement between a retracted position and an extended position, the second pivotal mounting arrangement including a second pivot placed intermediate the front section and the rear section of the seat member and pivotally mounting the seat member to the side rails at a second pivotal location juxtaposed with the frame brace such that the seat member is nested within the frame member, laterally between the side rails, when in the retracted position corresponding to the folded position, and the undersurface of the seat member rests upon the frame brace when in the extended position corresponding to the erect unfolded position;

an arrangement for preventing transverse relative movement between two said chairs stacked one upon another, said arrangement comprising:

restraining fingers extending outwardly from an undersurface of the opposite seat side sections of the seat member, each restraining finger extending in the lengthwise direction of the seat side sections, the restraining fingers fitting within and positioned immediately adjacent and in juxtaposition to inner surfaces of the side supports of another said chair stacked thereover, to prevent transverse relative movement between the stacked chairs; and at least one first stacking rib extending along and projecting orthogonally from one of:

rear surfaces of the side supports, or both a rear surface of the foot brace and the rear surfaces of the side supports, at a position adjacent the foot of the support member, the at least one first stacking rib having opposite rib ends; and inwardly facing raised bosses at inner surfaces of said side supports such that, in a stacking arrangement of two said chairs, the at least one first stacking rib of one said stacked chair fits between the inwardly facing raised bosses of another said stacked chair, with the opposite rib ends of the stacking rib in close proximity to the raised bosses of the other chair, to prevent transverse movement of the stacked chairs relative to each other.

11. A folding chair according to claim 10, wherein the inwardly facing raised bosses are provided at the inner surface of each side support at a position immediately above the basal brace.

* * * * *